US008302246B2

(12) United States Patent
Chudzik et al.

(10) Patent No.: US 8,302,246 B2
(45) Date of Patent: Nov. 6, 2012

(54) HAIR BRUSH WITH RETRACTABLE BRISTLES

(75) Inventors: Stan Chudzik, Alpharetta, GA (US); Michael Defenbaugh, Marietta, GA (US)

(73) Assignee: Goody Products, Inc., Atlanta, GA (US)

( * ) Notice: Subject to any disclaimer, the term of this patent is extended or adjusted under 35 U.S.C. 154(b) by 596 days.

(21) Appl. No.: 12/419,613

(22) Filed: Apr. 7, 2009

(65) Prior Publication Data

US 2009/0188062 A1 Jul. 30, 2009

Related U.S. Application Data

(63) Continuation-in-part of application No. 10/876,407, filed on Jun. 25, 2004, now Pat. No. 7,526,829.

(60) Provisional application No. 60/482,407, filed on Jun. 25, 2003.

(51) Int. Cl.
*A46B 7/06* (2006.01)
*A46B 9/08* (2006.01)

(52) U.S. Cl. ..... 15/169; 15/184; 15/203; 132/119; 132/120

(58) Field of Classification Search ..... 15/169, 15/184, 203; 132/119, 120, 121
See application file for complete search history.

(56) References Cited

U.S. PATENT DOCUMENTS 1,189,698 A * 7/1916 Keating ..... 15/184
1,231,093 A 6/1917 Sundeen
1,592,207 A * 7/1926 Havrilla ..... 15/167.1
2,482,928 A 9/1949 Neff et al.
2,486,203 A 10/1949 Pieper
2,604,649 A 7/1952 Stephenson
2,963,729 A 4/1958 Ib Thonbo et al.
2,981,965 A 5/1961 Kaye
3,086,236 A 4/1963 Anonsen
3,108,305 A 10/1963 Pielet
3,260,269 A 7/1966 Zurndorfer
3,739,419 A 6/1973 Natman et al.
3,947,914 A 4/1976 Jacoby (Continued)

FOREIGN PATENT DOCUMENTS

CA 2212920 3/1999

(Continued)

OTHER PUBLICATIONS

Partial machine translation of DE 8319974U, Dec. 1, 1983.*

(Continued)

*Primary Examiner* — Mark Spisich
(74) *Attorney, Agent, or Firm* — Lempia Summerfield Katz LLC

(57) ABSTRACT

A hair brush includes a brush head and a bristle/handle assembly. The head includes a cylindrical barrel with a plurality of apertures in it, and the bristle/handle assembly includes a handle and a bristle tree assembly. The bristle tree assembly includes a central bristle rod, a plurality of bristles radially extending from the rod, and a connecting rod extending between the bristle rod and the handle. The bristle rod is positioned within the barrel, and the bristles extend through the barrel apertures in an extended position. The brush head and the bristle/handle assembly are not attached to each other, and instead they slide longitudinally relative to each other. When the handle and the barrel are slid apart from each other, the bristle rod travels with the handle to retract the bristles to a retracted positioned further within the barrel.

10 Claims, 14 Drawing Sheets

U.S. PATENT DOCUMENTS

| | | | | |
|---|---|---|---|---|
| 3,977,420 | A | | 8/1976 | Yalof |
| 4,028,768 | A | | 6/1977 | Pascal |
| 4,103,387 | A | | 8/1978 | Anetsder, Jr. |
| 4,114,222 | A | | 9/1978 | Serediuk |
| 4,118,823 | A | | 10/1978 | Axelrod |
| 4,137,596 | A | | 2/1979 | Carlson |
| 4,250,590 | A | | 2/1981 | Chiang |
| 4,473,086 | A | | 9/1984 | Thaler |
| 4,475,563 | A | | 10/1984 | Martin |
| 4,479,501 | A | | 10/1984 | Chern |
| 4,567,905 | A | | 2/1986 | Stewart et al. |
| 4,574,416 | A | | 3/1986 | Stewart et al. |
| 4,596,261 | A | | 6/1986 | Renda et al. |
| 4,932,425 | A | | 6/1990 | Chen |
| 4,971,081 | A | | 11/1990 | Seja |
| 4,987,633 | A | | 1/1991 | Heneveld |
| 5,077,914 | A | | 1/1992 | Yamamoto |
| 5,095,892 | A | | 3/1992 | Tsumura |
| 5,261,426 | A | | 11/1993 | Kellett et al. |
| 5,327,611 | A | | 7/1994 | Balster et al. |
| 5,348,030 | A | | 9/1994 | Hirzel |
| 5,483,719 | A | | 1/1996 | Ikemoto et al. |
| 5,519,912 | A | * | 5/1996 | Kawamura ..... 15/160 |
| 5,815,877 | A | | 10/1998 | Heneveld |
| 5,862,563 | A | | 1/1999 | Hartmann |
| 5,887,600 | A | | 3/1999 | Wilk |
| 5,975,089 | A | | 11/1999 | Simon |
| 6,006,395 | A | | 12/1999 | Tiramani et al. |
| 6,014,976 | A | | 1/2000 | Denebeim |
| 6,021,542 | A | | 2/2000 | Norman |
| 6,029,307 | A | | 2/2000 | Baudoin |
| 6,070,594 | A | | 6/2000 | Mears |
| 6,070,597 | A | | 6/2000 | Motherhead |
| 6,341,611 | B1 | | 1/2002 | Nakamura |
| 6,382,216 | B1 | | 5/2002 | Clark |
| 6,408,475 | B1 | | 6/2002 | Morrison |
| 6,438,785 | B1 | | 8/2002 | Smith |
| 6,631,831 | B1 | | 10/2003 | Loiselle |
| 6,968,848 | B2 | | 11/2005 | Grant et al. |
| 2001/0001887 | A1 | | 5/2001 | Bigio |
| 2002/0078971 | A1 | | 6/2002 | Anderson |
| 2003/0000900 | A1 | | 1/2003 | Yu |
| 2007/0199170 | A1 | | 8/2007 | DiPippo |

FOREIGN PATENT DOCUMENTS

| | | | |
|---|---|---|---|
| DE | 2923740 | | 12/1980 |
| DE | 8319974.8 | | 12/1983 |
| DE | 3602052 | | 7/1987 |
| DE | 3602052 | A1 | 7/1987 |
| DE | 4127758 | A1 | 2/1993 |
| DE | 20019552 | | 2/2001 |
| EP | 0168099 | A2 | 5/1986 |
| EP | 185284 | | 6/1986 |
| EP | 0240006 | A2 | 10/1987 |
| EP | 0882414 | A2 | 5/1998 |
| FR | 2482842 | | 11/1981 |
| GB | 191228155 | | 0/1913 |
| GB | 191408334 | A1 | 0/1914 |
| GB | 794594 | | 5/1958 |

OTHER PUBLICATIONS

International Search Report; from the International Searching Authority; May 21, 2010; 8 pages.

European Search Report for European Patent Application No. EP04014946, dated Dec. 16, 2004, 6 pages.

* cited by examiner

HAIR BRUSH WITH RETRACTABLE BRISTLES

CROSS-REFERENCE TO RELATED APPLICATIONS

The present application is a continuation-in-part of U.S. nonprovisional patent application Ser. No. 10/876,407 filed on Jun. 25, 2004 now U.S. Pat. No. 7,526,829, which claims the priority benefit of U.S. provisional application Ser. No. 60/482,407 filed on Jun. 25, 2003, the disclosures of which are expressly incorporated by reference herein in their entireties for all purposes.

FIELD OF THE INVENTION

The present invention relates generally to hair brushes and, more particularly, to a hair brush that can be manipulated by the user to retract the bristles.

BACKGROUND OF THE INVENTION

Hair brushes in general are known in the art. Similarly, hair brushes having retractable bristles or self-cleaning features, and features for added comfort, are also known in the art. For example, one type of a self-cleaning hair brush includes retractable bristles that enable the user to remove strands of hair from a top of the brush once the bristles have been retracted. One such brush is disclosed in U.S. Pat. No. 4,574,416 and utilizes a brush head, a spring, and a lever to retract the bristles relative to the head of the brush. More specifically, the brush head is disposed at an end of the lever which pivots about a pivot point in the body of the brush. The spring biases the lever and hence the bristle head to a position such that the bristles of the brush are in a retracted position. The user extends the bristles for use by depressing the lever against the bias of the spring and forcing the bristles out from the head of the brush.

Another brush having retractable bristles is disclosed in U.S. Pat. No. 5,815,877 and includes a base, an actuation member, and a plurality of bristles. The bristles are attached to the actuation member which is slidably attached to the base. The bristles are retracted by pulling the actuation member toward the user relative to the base. By doing so, the bristles, which are positioned perpendicular to the actuation member in the extended position, are forced to a parallel position relative to the actuation member and hence are retracted into the base/actuation member. The bristles are extended by pushing the actuation member into the base, thereby positioning the bristles perpendicular to the actuation member.

Another brush having retractable bristles is disclosed in U.S. Pat. No. 5,862,563 and includes body, a backing member, springs, a base, an actuating element, and a plurality of bristles. The bristles are attached to the backing member, which is operatively attached to the actuating element. The springs are located underneath and bias the backing member against the body of the brush such that the bristles extend from the body. The bristles are retracted into the body by depressing the actuating element against the bias of the springs. To extend the bristles from the body, the user releases the depressed actuating element such that the bias of the springs returns the backing member against the body of the brush, and hence extends the bristles.

Another brush having retractable bristles is disclosed in U.S. Pat. No. 5,862,563 and includes an outer tubular member having apertures and an inner tubular member. A plurality of bristles are rotatably mounted on the inner tubular member and extend through the apertures. By rotation of the outer tubular member relative to the inner tubular member, the bristles, depending on the direction of rotation, either extend from or retract into the outer tubular member.

These types of retractable bristle/self-cleaning hair brushes, however, each have one or more problematic aspects or features. For example, these brushes all require a complicated and multi-piece mechanism to effectuate retraction and extension of the bristles, making the brushes costly to manufacture and more susceptible to breakage and malfunction. Similarly, these brushes are not designed for the comfort of the user and, therefore, have features not optimal for user comfort.

Moreover, most round brushes with bristle-retraction mechanisms require the use of both hands to retract the bristles. This is particularly problematic when the brush gets tangled in the user's hair, for example, during blow-drying. Brushes with bristle-retracting mechanisms permit the user to retract the bristles into the brush head, thereby untangling the brush from the hair. But this is cumbersome to do when using most brushes with known bristle-retracting mechanisms. This is because the user must free her other hand (the one not holding the brush), for example by setting down a hair dryer held in that hand, and then reach around the back of her head to operate the bristle-retracting mechanism.

Accordingly, it can be seen that needs exist for hair brushes with improved bristle-retracting features, preferably providing for one-handed use. It is to the provision of solutions to these and other problems that the present invention is primarily directed.

SUMMARY OF THE INVENTION

In accordance with one aspect of the disclosure, a hair brush having a body, a cushion pad, and a plurality of bristles, is disclosed. The body includes a first end at which at least a partial cavity is disposed. The cavity includes a front portion, a rear portion, and a plurality of apertures. The cushion pad includes a first surface that is disposed near the front portion of the cavity when the hair brush is in a user position, and a second surface that is disposed near the rear portion of the cavity when the hair brush is in a cleaning position. The plurality of bristles are disposed on the cushion pad such that a first end of the bristles extends substantially perpendicular from the first surface of the cushion pad through the apertures in the front portion of the cavity.

In accordance with another aspect of the disclosure, a hair brush having a body, a central elongate portion and a plurality of bristles is disclosed. The body includes a generally cylindrical portion having an outer surface and a plurality of apertures, wherein the generally cylindrical portion is disposed near the first end of the body. The central elongate portion includes a first end and a second end, and is disposed at least partially inside the cylindrical portion. Each of the plurality of bristles has a first end that extends from the central elongate portion through a corresponding one of the apertures in the cylindrical portion of the body. A second end of each of the plurality of bristles is disposed near the outer surface of the cylindrical portion in a cleaning position, and is disposed away from the outer surface of the cylindrical portion in a user position.

In accordance with another aspect of the disclosure, a hair brush having a body, a head, and a plurality of bristles is disclosed. The head is disposed near a first end of the body, and the plurality of bristles are disposed on the head of the body. A bristle density and bristle length are based on at least one of a length, texture, amount, and thickness a hair type.

In accordance with another aspect of the disclosure, a hair brush system having a plurality of brushes is disclosed. The plurality of hair brushes each have different types of bristles and include a first of the plurality of hair brushes having a first type of bristles adapted to be used with a first type of hair, and a second of the plurality of hair brushes having a second type of bristles adapted to be used with a second type of hair. The first type of bristles and the second type of bristles differ in at least one of a bristle density and a bristle length.

In accordance with another aspect of the disclosure, a method of providing hair brushes for various types of hair is disclosed. The method includes providing a first hair brush having a first type of bristle adapted to be used with a first type of hair, and a second hair brush having a second type of bristle adapted to be used with a second type of hair. The first type of bristles and the second type of bristles differ in at least one of a bristle density and a bristle length.

In accordance with another aspect of the disclosure, a method of determining hair brushes for various types of hair is disclosed. The method includes categorizing hair types based on at least one of a length, texture, amount, and thickness of hair, and providing a plurality of hair brushes having a different bristle type. The method further includes correlating a first hair type to a first of the plurality of hair brushes having a first bristle type, and correlating a second hair type to a second of the plurality of hair brushes having a second bristle type. The first bristle type and the second bristle type differ in at least one of a bristle density and a bristle length.

In accordance with another aspect of the disclosure, a hair roller is disclosed. The hair roller includes a generally cylindrical body, a central elongate portion, and a plurality of bristles. The generally cylindrical body includes an outer surface and a plurality of apertures, and the central elongate portion has a first end and a second end and is disposed at least partially inside the cylindrical portion. The plurality of bristles have a first end that extend from the central elongate portion through the apertures in the body, and a second end that are disposed near the outer surface of the body in a cleaning position, and are disposed away from the outer surface of the body in a user position.

In accordance with another aspect of the disclosure, another retractable-bristle hair brush is disclosed. The hair brush includes a brush head, a brush handle, and a bristle tree within the head. The bristle tree has bristles that extend through apertures in the head in an extended position. The bristle tree is attached to the handle by a connecting rod and is not attached to the head, so when an axial separating force is applied to the head or handle they longitudinally slide relative to each other. The bristle tree travels with the handle, so it slides axially within the head, thereby retracting the bristles to a retracted position with more of the bristle lengths inside the head.

In accordance with yet another aspect of the disclosure, another retractable-bristle hair brush is disclosed. The hair brush includes a brush head, a brush handle extending from the head, and a bristle tree within the head. The bristle tree has bristles that extend through apertures in the head in an extended position. The bristle tree is attached to a plunger at the proximal end of the handle by a connecting rod and is not attached to the head, so when an axial separating force is applied to the head or the plunger (e.g., to a finger-engaging element such as a loop extending from the plunger) they longitudinally slide relative to each other. The bristle tree travels with the plunger, so it slides axially within the head, thereby retracting the bristles to a retracted position with more of the bristle lengths inside the head.

In accordance with still another aspect of the disclosure, another retractable-bristle hair brush is disclosed. The hair brush includes a brush head, a brush handle extending from the head, and a bristle tree within the head. The bristle tree has bristles that extend through apertures in the head in an extended position. The bristle tree is attached to a cam, which is rotationally mounted to the handle, by a connecting rod and is not attached to the head, so when a separating force is applied to a finger-engaging element (e.g., a lever) extending from the cam, the cam rotates and transfers the force to the connecting rod. This causes the connecting rod to slide longitudinally, and the bristle tree travels with the connecting rod. So the bristle tree slides longitudinally within the head, thereby retracting the bristles to a retracted position with more of the bristle lengths inside the head.

These and other aspects, features, and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are explanatory of example embodiments of the invention, and are not restrictive of the invention, as claimed.

BRIEF DESCRIPTION OF THE DRAWINGS

The advantages of the present invention will be apparent upon reading the following description in conjunction with the drawings, in which.

Figure 1:
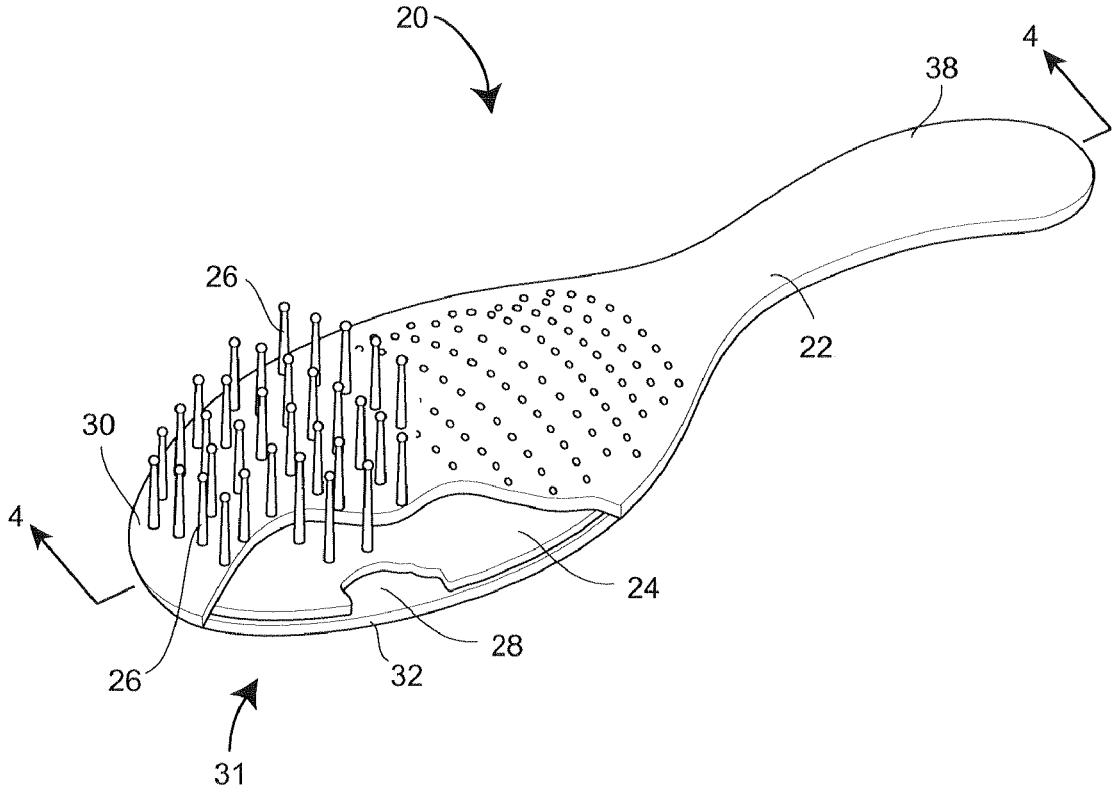
FIG. 1 is perspective view of a self-cleaning comfort hair brush according to an example embodiment of the invention.

While the invention is susceptible to various modifications and alternative constructions, certain illustrative embodiments thereof have been shown in the drawings and will be described below in detail. It should be understood, however, that there is no intention to limit the invention to the specific forms disclosed, but, on the contrary, the intention is to cover all modifications, alternative constructions, and equivalents falling within the spirit and scope of the disclosure and the appended claims.

DETAILED DESCRIPTION OF EXAMPLE EMBODIMENTS OF THE INVENTION

Referring now to the drawings, and with specific reference initially to FIG. 1, a self-cleaning comfort hair brush 20 includes a body 22, a cushion pad 24, and a plurality of bristles 26. The hair brush 20, as depicted in FIG. 1 is only one exemplary type of hair brush 20 and, more particularly, one exemplary type of hair brush head that may be used in conjunction with the present disclosure. The hair brush 20 is, therefore, not limited to an oval-shaped brush head as depicted in FIG. 1, but may include any of the brush heads disclosed herein and others.

Figure 2:
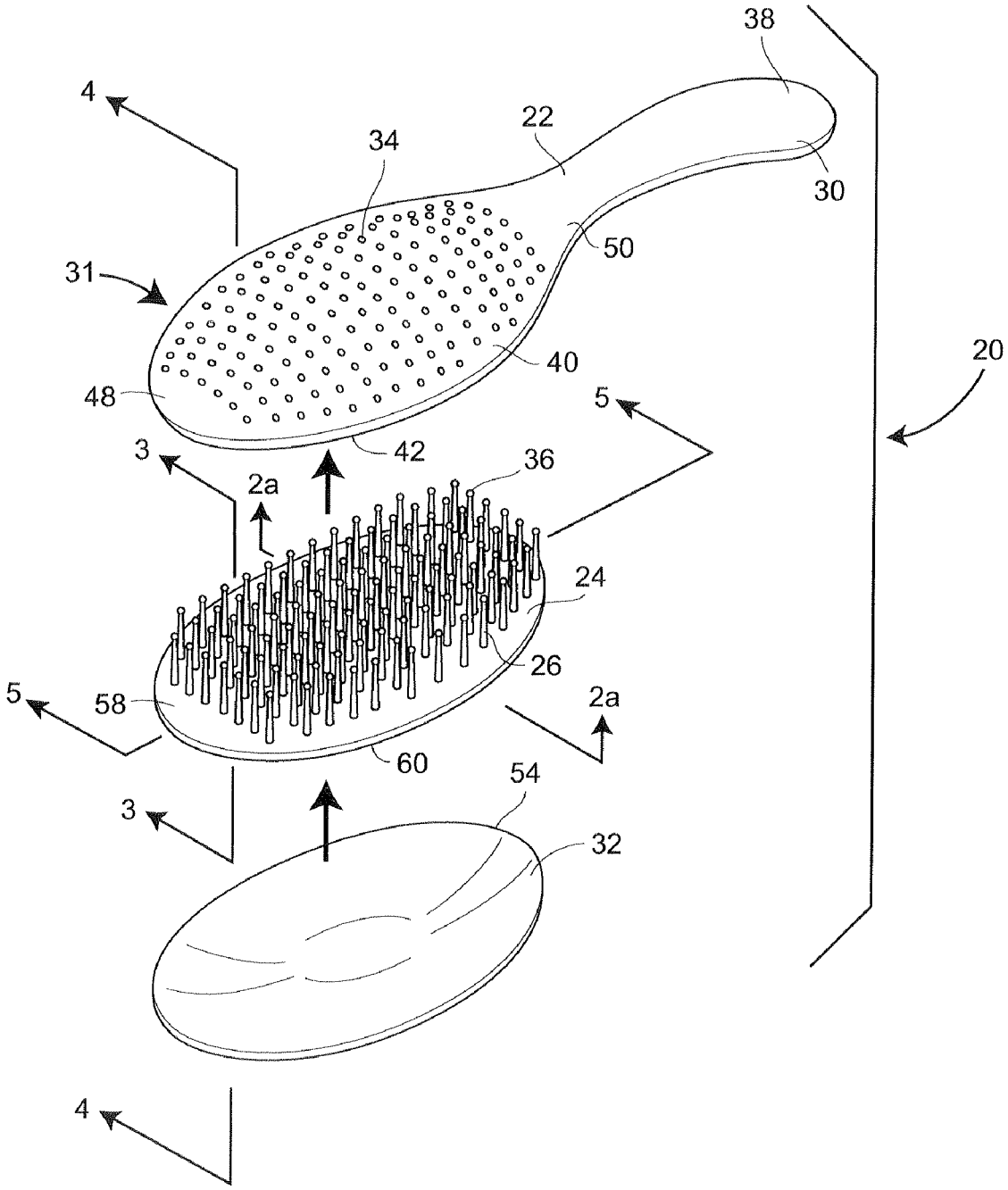
FIG. 2 is an exploded perspective view of the self-cleaning comfort hair brush of FIG. 1.
Figure 4:
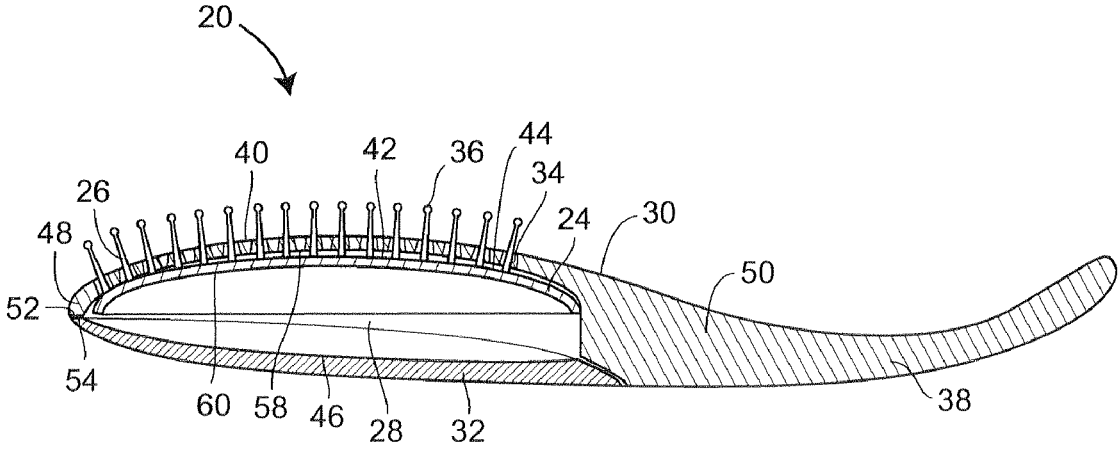
FIG. 4 is a cross-sectional view of the self-cleaning comfort hair brush of FIG. 1 in a user position.

The hair brush 20 is intended to provide a comfortable brush that is self-cleaning and/or has a self-cleaning mechanism. More specifically, the bristles 26 are attached to and extend substantially or generally perpendicularly from the cushion pad 24 located in a cavity 28, as illustrated in FIGS. 2 and 4. The cushion pad 24 is constructed from a flexible material, and can be moved such that it is disposed near a front portion 30 of the body 22 with bristles extending outwardly through aperture 34 when the hair brush 20 is in an user position, or is disposed near a rear portion 32 of the body 22 when the hair brush 20 is in a cleaning position. The bristles 26 extend through apertures 34 located on the front portion 30 of the body 22, such that tips 36 of the bristles 26 are disposed away from the front portion 30 in a user position, and are disposed near the front portion 30 or at least partially retracted within the cavity 28 in a cleaning position.

A hair brush system incorporating various features of the hair brush 20 is intended to provide a hair brush 20 selectable from an array of brushes and adapted for a person's specific type and/or style of hair. More specifically, the user's hair type may be categorized in many ways including, but not limited to, amount or density, shape, width or diameter, and length of the hair. Similarly, the person's hair style may vary. A brush with the length and density of the bristles 26, as illustrated in FIGS. 8-17 may, therefore, be appropriately chosen to accommodate the various type and style of hair.

In one exemplary embodiment as illustrated in FIGS. 1-2, the body 22 includes a head 31 defining the cavity 28 therein, and a handle 38. The handle 38 extends from the front portion 30, and the cavity 28 is disposed between the front portion 30 and the rear portion 32 at the body 22. The hair brush 20 may, however, be constructed without the handle 38, such that the user would grasp, for example, the head 31 of the brush 20 during use. Conversely, the hair brush 20 may include several additional elements or pieces. For example, the handle 38 may be constructed from a plurality of pieces; similarly, the front and rear portions 30, 32 may be constructed of additional pieces and/or be connected at other locations. The front portion 30 of the body 22 has an outside surface 40 and an inside surface 42, wherein the apertures 34 are located between the inside surface 42 and the outside surface 40. The inside surface 42 of the front portion 30 may also define an upper surface or front wall 44 of the cavity 28. A rear wall 46 of the cavity 28 defined by an inner surface of rear portion 32 is disposed opposite the front wall 44.

The body 22 may be constructed from one or more pieces and, as in this example, may be constructed from two portions, the front portion 30 and the rear portion 32. The front portion 30 may include the handle 38, and may in part create the front wall 44 of the cavity 28. The rear portion 32 of the body 22 may be disposed to the rear of the front portion 30, such that the rear portion 32 may in part create the rear wall 46 of the cavity 28.

Figure 5:
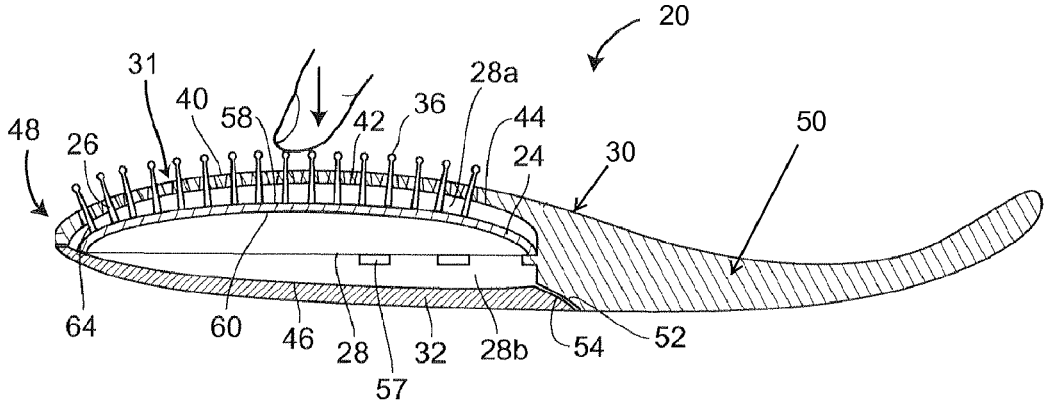
FIG. 5 is a cross-sectional view of the self-cleaning comfort hair brush of FIG. 2 in a cleaning position.

More specifically, as best illustrated in FIGS. 2 and 5, the front portion 30 includes a first end 48 and a second end 50. The first end 48 of the front portion 30 includes the apertures 34 and a first mating surface 52, and the second end 50 includes the handle 38. The first mating surface 52 is located around the perimeter of a first section 28*a* of the cavity 28 and may be adapted to receive a second mating surface 54 located on the rear portion 32 of the body 22. The rear portion 32 may create a second section 28*b* of the cavity 28 and may include the second mating surface 54. The second mating surface 54 is located around the perimeter of the rear portion 32 of the body 22, and may be adapted to engage with the first mating surface 52, such that upon connection of the mating surfaces 52, 54, the cavity 28 is formed.

Figure 2A:
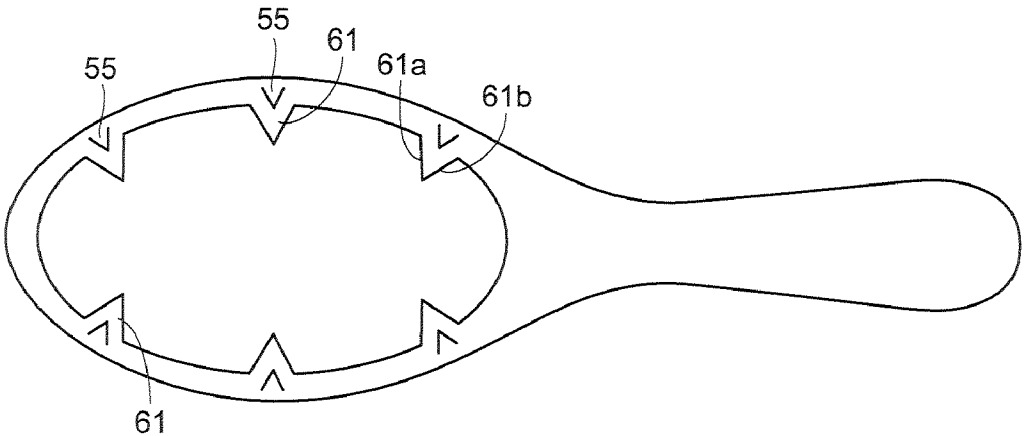
FIG. 2*a* is a plan view of the comfort hair brush taken along line 2*a*-2*a* of FIG. 2.

The body 22 may also include one or more positioning members 55, located along the perimeter of the cavity 28, as seen in FIG. 2*a*. The positioning members 55 may depend from the perimeter of the cavity 28 and extend radially inward.

The body 22 and the cavity 28 may, however, be formed in many other ways with many additional and/or alternate features. For example, the front portion 30 and the rear portion 32 may be attached or engaged via a ledge and corresponding recess. More specifically, the mating surfaces 52, 54 may include a complimentary ledge and recess, such that the rear portion 32 may snap onto the front portion 30 via the ledge and recess, without adhesive. Similarly, the hair brush 20 may be constructed from a single piece and may not include the rear portion 32. The cavity 28 in such an example, may only be partially enclosed. Other methods of forming the body 22 and cavity 28 may include connecting the front portion 30 and the cushion pad 24 together without a rear portion 32 where the cushion pad 24 is attached to the front portion 30. The cushion pad 24 may be constructed by other materials listed below. The cushion pad 24 can also be constructed in pieces with mobile joints that allows movement, with the movement being enhanced or regulated by additional material such as gel-like substance, water, plasmic type of material that is behind the cushion pad 24, and granular substance such as sand, marble, or dust. These materials may require glue or adhesives to retain its position relative to the cushion pad 24, and may or may not require a rear cavity 32 to contain itself. The rear portion 32 can be eliminated or constructed together with the front portion 30 as a whole part. The substances behind the cushion pad 24 may be functional in nature or aesthetic. In addition the front portion 30 is not required to have a dome-like curvature. The front portion 30 can also be of a flat surface, textured surface, ribbed with undulating wall thicknesses, or include additional material that creates a textured feel. For example, the front wall 44 of the front portion 30 may include a molded rubber for texture, or an oil absorbing fabric, and may be decorative and ornamental as well.

Figure 10:
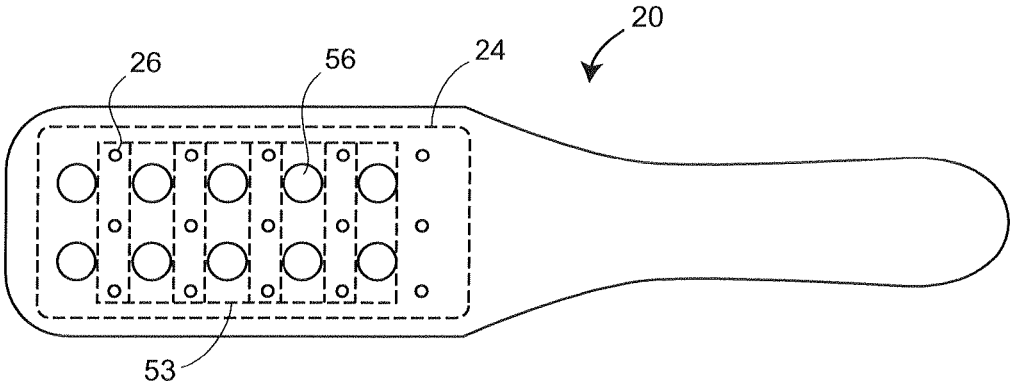
FIG. 10 is a front plan view of a low-density bristle pattern of a vented brush.
Figure 13:
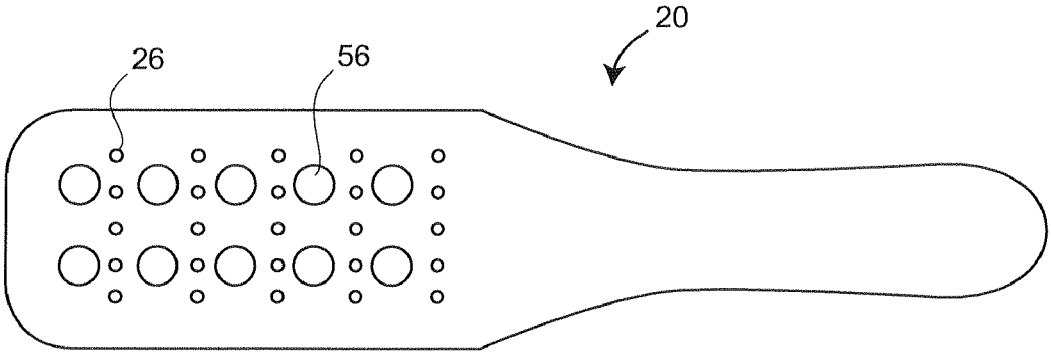
FIG. 13 is a front plan view of a medium-density bristle pattern of a vented brush.
Figure 16:
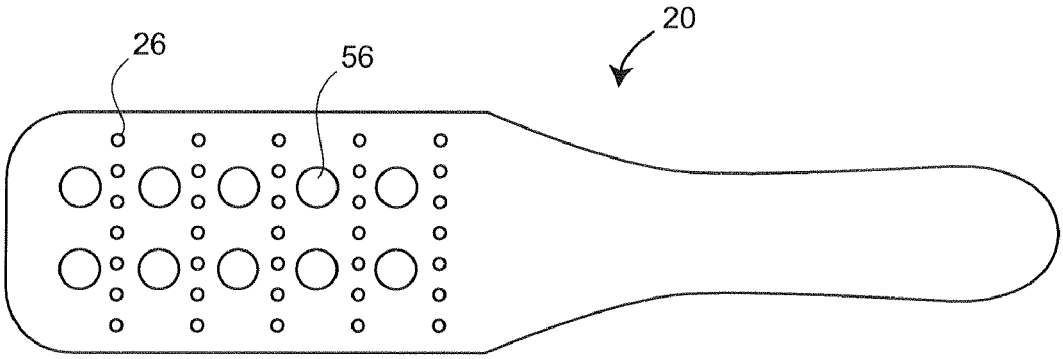
FIG. 16 is a front plan view of a high-density bristle pattern of a vented brush.

In another example, the body 22 may include additional apertures 56 both on the front and rear portions 30, 32, as seen in FIGS. 10, 13, and 16, such that air (i.e., from a hairdryer) may penetrate the head of the hair brush 20. Similarly, the cushion pad 24 may include additional apertures 53 corresponding to the apertures 56, as seen in FIG. 10, such that air may penetrate the cushion pad 24. The apertures 53, as seen in FIG. 10, may be slots or cut-outs from the cushion pad 24, thereby allowing air may penetrate the cushion pad 24. Alternatively, the apertures 53 may in fact create separations in the cushion pad 24, such that the cushion pad 24 is constructed from a plurality of strips or pieces that contain the bristles 26.

The body 22 can be fabricated from relatively light weight, durable, and sturdy plastic materials such as polyethylene, polypropylene, polystyrene, or other suitable plastic materials, including but no limited to wood, metal, and composites. Similarly, the body 22 can be injection molded, blow molded, continuously molded, extruded, vacuum formed, or the like. The manufacturing process or processes and materials can be selected based on feasibility, cost, tooling concerns, as well as other factors for a given application. The optimal method of manufacturing is to use injection molding to form the front and rear portions 30, 32. The bristles 26 and cushion pad 24 can be simultaneously molded through injection molding with the bristles 26 being contained within the cushion pad 24. Alternatively, the bristles 26 may be molded separately and assembled in a molded cushion pad 24 and reinforced with glue or fabric to further stabilize the bristles 26 to prevent bristles 26 from depressing through the cushion pad 24.

The cushion pad 24, as illustrated in FIGS. 2, 4, and 5, is disposed within the cavity 28 and includes a front surface 58 and a rear surface 60 that, in this example, are substantially parallel to each other. The cushion pad 24, when in use, may have a generally convex shape, which may be the result of placement of the cushion pad 24 into the cavity 28 and/or the body 22. More specifically, the cushion pad 24 may be constructed or formed such that the cushion pad 24 has a generally convex shape independent of the cavity 28 and the body 22. The cushion pad 24 may alternatively be constructed or formed such that the cushion pad 24 has a generally planar shape and only obtains its convex shape once inserted into the cavity 28 and/or the body 22.

In one exemplary embodiment, at least a portion of a perimeter of the cushion pad 24, as seen in the left portion of the head 31 in FIG. 5, may rest on the front or rear portion 30, 32 of the hair brush 20, thereby providing the cushion pad 24 and, more specifically, the perimeter of the cushion pad 24 a stop or the like, to enable the cushion pad 24 to retain the convex shape. Additionally and/or alternatively, as seen in the right portion of the head 31 in FIG. 5, at least a portion of the perimeter of the cushion pad 24 may rest on a ledge or protrusion 57 extending inwardly from the front or rear portion 30, 32 toward the cavity 28. The perimeter of the cushion pad 24, however, need not abut a stop or the like to enable the cushion pad 24 to retain the convex shape, but may retain the convex shape by some other means such as, for example, the engagement of the bristles 26 with the apertures 34.

Once having a convex shape, the cushion pad 24, in this example, is biased to remain in the convex shape, due to the construction or placement of the cushion pad 24 in the cavity 28 and/or body 22. The rear surface 60 of the cushion pad 24 may be disposed along the rear wall 46 of the cavity 28 when the hair brush 20 is in the cleaning position, such that the cushion pad 24 may have a substantially similar contour to the rear wall 46 of the rear portion 32. The cushion pad 24 may be fabricated from relatively resilient and flexible materials such as rubber, fabric, plastic with high pliability, or plastic connected by joints to enable movement, paper-like material such as vellum, mylar, acetate, metal with high pliability in sheets or connected by joints, wooden pieces connected by joints to enable movement, or other suitable flexible material, or any material joined or designed to create flexible movement.

Additionally, the cushion pad 24 may include holes, ribs, slots, and/or other features to locally effect the flexibility of the cushion pad 24. For example, as seen in FIG. 2*a*, the cushion pad may include one or more relieves, such as angled cut-outs 61 as in this embodiment. The angled cut-outs 61 are located at the perimeter of the cushion pad 24, and extend inwardly. The angled cut-outs 61 may allow the cushion pad 24 to conform to the front portion 30 without overlapping parts. More specifically, the angled-cuts may allow the cushion pad 24 to conform to a convex and/or concave shape as defined by the cavity 28.

Figure 3:
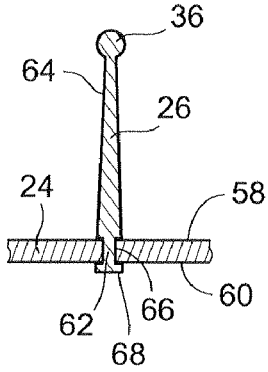
FIG. 3 is a cross-sectional view of a portion of a cushion pad and bristles taken along line 3-3 of FIG. 2.

The bristles 26, as illustrated in FIGS. 3 and 4, extend substantially perpendicular to the cushion pad 24 and include a first end 62 and a second end 64, wherein the second end 64 includes the tip 36. The first end 62 of the bristles 26 are adapted to fixedly or removably attach to the cushion pad 24, and the second end 64 of the bristles 26 are adapted to contact the user's scalp. More specifically, the first end 62 of the bristles 26 may include an annular groove 66 and a flange 68, which are arranged such that to one side of the groove 66 is the flange 68 and to the other side of the groove 66 is the remainder of the bristle 26. As seen in FIG. 3, the annular groove 66 engages the cushion pad 24 and is secured by the flange 68 at the rear surface 60 of the cushion pad 24, and by the remainder of the bristle 26 on the front surface 58 of the cushion pad 24. The bristle 26, may however, be attached to the cushion 24 in other manners, including, but not limited to, adhesive, press-fit, interference-fit, or the like, or can be removably attached and be replaceable. Additionally, the bristles 26 may be integrally molded with the cushion pad 24, in a one step or two step molding process. The second end 64 of the bristles 26 includes the tip 36 which may include a feature adapted to make the hair brush 20 more comfortable on the user's scalp. In this exemplary embodiment, the tip 36 is rounded or spherically shaped, which makes engagement with the user's scalp less harsh and more comfortable than without. The length of the bristles 26 may be constant throughout the hair brush 20, but may also vary according to need and design, such that the tips 36 of the bristled 26 are staggered and not equidistant to the outside surface 40 of the front portion 30.

In operation, the hair brush 20 has several positions, including a user position and a cleaning position. In the user position, as illustrated in FIG. 4, i.e. as the user is brushing hair, the front surface 58 of the cushion pad 24 is disposed substantially along the inside surface 42 of the front portion 30 of the body 22, such that the bristles 26 extend outwardly from the front surface 58 of the cushion pad 24 through the apertures 34. As such, the tips 36 of the bristles 26 are disposed away from the outside surface 40 front portion 30 of the body 22.

However, as the hair brush 20 and, more specifically, as the bristles 26 come into contact with the user's scalp, the front surface 58 of the cushion pad 24 may be forced away from the inside surface 42 of the portion 30 of the body 22, such that cushion pad 24 is forced from the initial convex shape to a less convex shape, a planar shape or even a concave shape, as illustrated in FIG. 5. More specifically, to make using the hair brush 20 more comfortable, the cushion pad 24 may be designed to absorb a force and/or distance that is in excess of the force and/or distance required to make contact between the bristles 26 and the user's scalp. The cushion pad 24, having a generally convex shape may, therefore, temporarily deform to accommodate the extra force and/or distance that is in excess of the force and/or distance required to make contact between the bristles 26 and the user's scalp.

In a cleaning position, the rear surface 60 of the cushion pad 24 is disposed substantially along the rear surface 46 of the cavity 28, such that the tips 36 of the bristles 26 are disposed near the outside surface 40 of the front portion 30 of the body 22. More specifically, to make cleaning accumulated strands of hair from the bristles 26 easier, the cushion pad 24 is deformed or moved to cause the bristle 26 to at least partially retract into the front portion 30 and/or the body 22. As illustrated in FIG. 5, the user may depress the bristles 26 into the front portion 30 and/or the body 22, thereby causing the bristles 26 to retract, causing the cushion pad 24 to deform. Upon retraction, the hair is accumulated at a top of the apertures 34 as the hair is prevented from moving with he bristles 26 by the stationary front portion 30.

The cushion pad 24 may move within the cavity 28 by many methods. In one method, the cushion pad 24 may be suspended between the two cavities 28*a*, 28*b*. Due to the nature of rubber material, the cushion pad 24 conforms to the first cavity 28*a* of the hair brush 20. When the rubber is depressed, due to the nature of the material, the cushion pad 24 has a natural tendency to flex, depress and remit to its original shape.

The position members 55 and/or the angled cut-outs 61 may aid in the flexing and/or aligning of the cushion pad 24. For example, as the cushion pad 24 flexes either convexly or concavely, the perimeter of the cushion pad 24 may have a tendency to compress and/or bunch. The angled cut-outs 61 may allow the cushion pad 24 variable flexibility depending of the size of the angled cut-outs 61 and/or the positioning members 55. In combination, the positioning members 55 and the angled cut-outs 61 may align the cushion pad 24 in the cavity 28, and hence relative to the front portion 30 having the apertures 34. More specifically, as illustrated in FIG. 2*a*, the positioning members 55 and the angled cut-outs 61 may engage, such that the sides 61*a* and 61*b* of the angled cut-outs 61 are disposed on either side of the positioning members 55. As such, the cushion pad 24 will be aligned in the cavity 28, and hence the front portion 30 and apertures 34.

Figure 6:
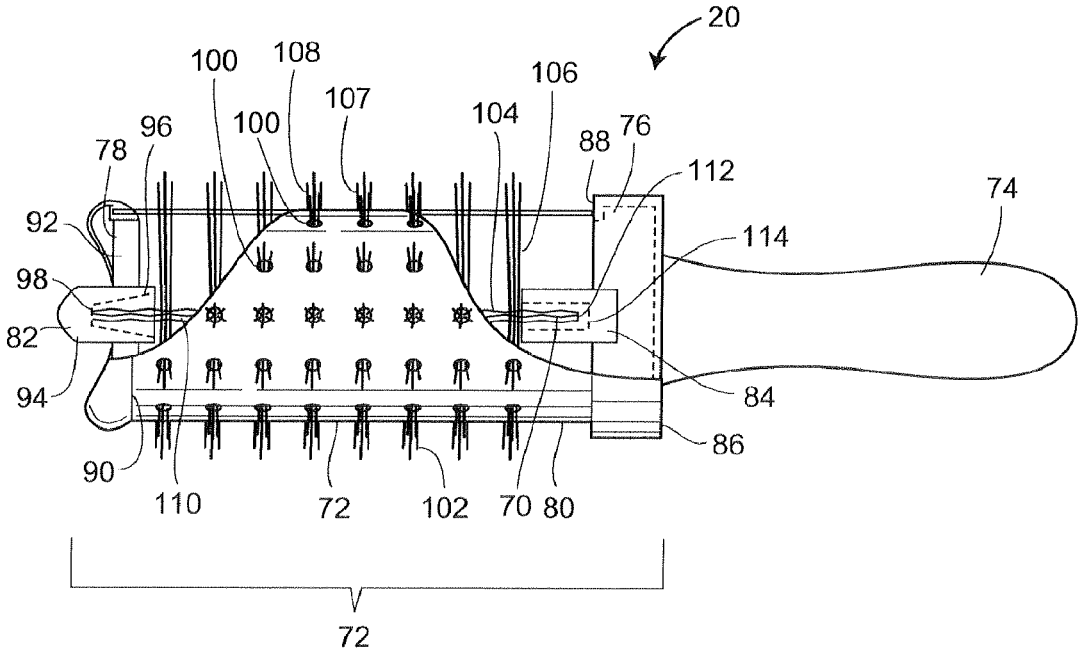
FIG. 6 is a side view with broken-out sections of a round self-cleaning comfort hair brush according to another example embodiment of the invention, showing the brush in a user position.
Figure 7:
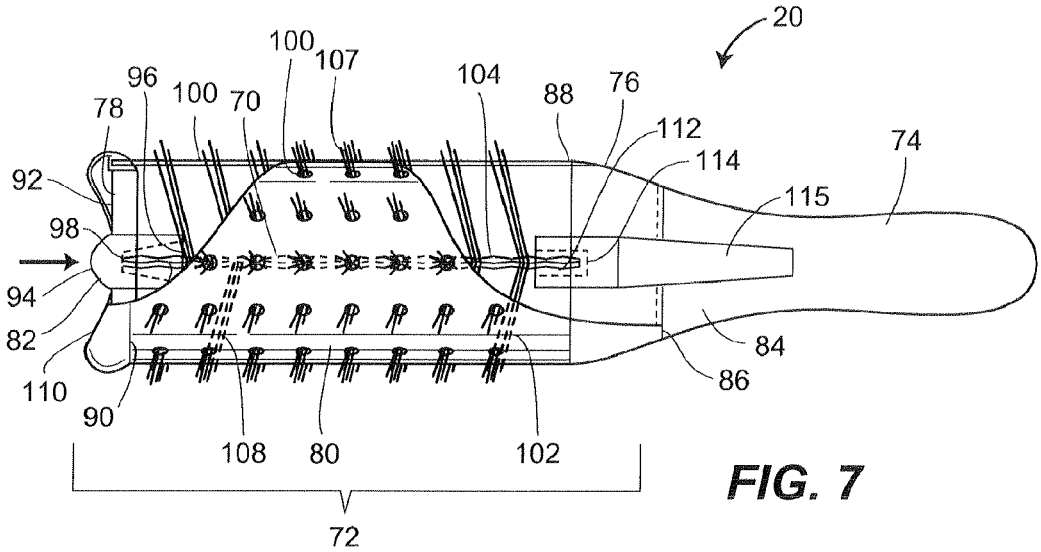
FIG. 7 is a side view with broken-out sections of the round self-cleaning comfort hair brush of FIG. 6 in a cleaning position.
Figure 7A:
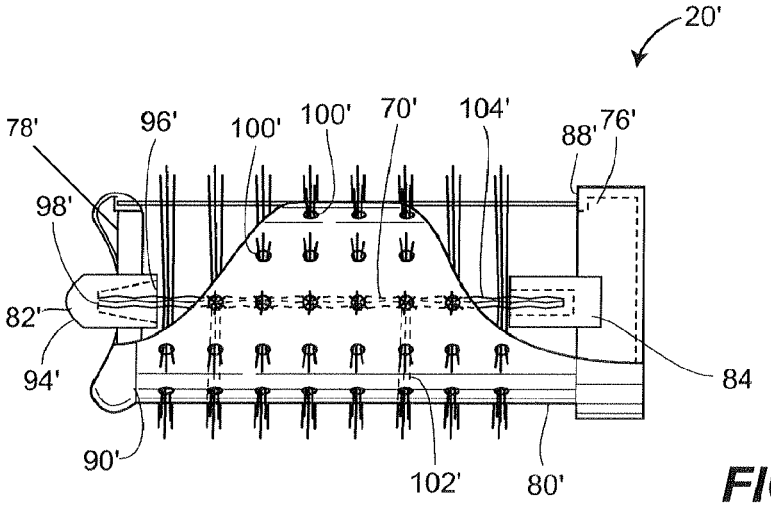
FIG. 7*a* is a side view with broken-out sections of a round self-cleaning comfort hair roller in a user position.

In another exemplary embodiment illustrated in FIGS. 6 and 7 the hair brush 20 may not include a cushion pad 24, but may include an elongate central axis rod 70. In this embodiment, a body 72 may include a handle 74, a first end cap 76, a second end cap 78, a central annular portion 80 located between the first end cap 76 and the second end cap 78, an activation button 82, and a receiving portion 84. The handle 74 depends from a first side 86 of the first end cap 76. A second side 88 of the first end cap 76 includes a circular recess portion that receives the central annular portion 80. The first end cap 76 and the handle 74 may, however, be an integral unit (FIG. 7) and may be constructed such an exterior surface of the first end cap 76 and an exterior surface of the central annular portion 80 are substantially planar or flat, such that no observable step between the first end cap 76 and the central annular portion 80 exists. A first side 90 of the second end cap 78 receives the other end of the central annular portion 80 and, more specifically, receives the central annular portion 80 within a circular recess. The second end cap 78 may be constructed such that an exterior surface of the second end cap 78 and an exterior surface of the central annular portion 80 are substantially planar or flat (FIG. 7), such that no observable step between the second end cap 78 and the central annular portion 80 exists. The activation button 82 is located along the central longitudinal axis of the central annular portion 80 within the second end cap 78. More specifically, the activation button 82 includes a first end 94 and a second end 96, wherein the first end 94 is adapted to be engaged by a user, and the second end 96 includes a cup portion 98 adapted to receive the elongate central axis rod 70.

The central annular portion 80 may be generally cylindrical and, more specifically, may have a generally circular cylindrical shape. A plurality of apertures 100 located around the central annular portion 80 receive bristles 102 that are disposed from the elongate central axis rod 70 through the apertures 100.

The elongate central axis rod 70 may have a semi-rigid to rigid construction from which the bristles 102 extend. More specifically, as in this example, the elongate central axis rod 70 is constructed from a plurality of rods or wires 104 that are twisted together to form the elongate central axis rod 70. The elongate central axis rod 70 may, however, be molded using various types of molding techniques, including being integrally molded with the bristles 102.

The bristles 102 extend radially outward from the elongate central axis rod 70 and are fixedly attached thereto. In this example, the bristles 102 are attached to the elongate central axis rod 70 by being wedged between the rods 104 as the rods 104 are twisted together. More specifically, prior to the rods 104 being twisted together, the bristles 102 may be placed between the rods 104, such that the bristles 102 are oriented generally perpendicular to the rods 104 and such that the bristles 102 abut the rods 104 near an inner section 106 of the bristles 102. Once the rods 104 are twisted and the bristles 102 are wedged therebetween, outer sections 108 of the bristles 102 will extend in substantially equal length from opposite sides of the elongate central axis rod 70. The bristles 102 may, however, have varying length such that the outer sections 108 of the bristles 102 are staggered and not equidistant to the elongate central axis rod 70.

In operation of this exemplary embodiment, the hair brush 20 may be in one or more positions, including the cleaning position and the user position. In the user position, as seen in FIG. 6, the activation button 82 is located in an outward position, such that the activation button 82 extends from a second side 92 of the second end cap 78, and the bristles 102 are oriented substantially perpendicular to the elongate central axis rod 70. In this position, the outer portions 108 of the bristles 102 extend through the apertures 100 and outwardly from the central annular portion 80. The bristles 102 are in their natural state at this point, because the rigidity of the bristles 102 and their attachment to the elongate central axis rod 70 cause the bristles 102 to have a tendency or bias to be substantially perpendicular to the elongate central axis rod 70, and hence in the user position.

The hair brush 20 may be changed from the user position to the cleaning position by depressing the activation button 82. More specifically, the activation button 82 may be depressed, thereby causing the cup portion 98 located on the bottom of the activation button 82 to abut a second end 110 of the elongate central axis rod 70. The elongate central axis rod 70 will move axially along the central axis of the central annular portion 80, until a first end 112 of the elongate central axis rod 70 abuts a bottom 114 of the receiving portion 84. Alternatively, the elongate central axis rod 70 will move axially along the central axis of the central annular portion 80, until a stop (not show) on the activation button 82 prevents further depression of the activation button 82 into the second end cap 78. During movement of the second end 110 of the elongate central axis rod 70 toward the receiving portion 84, walls of the activation button 82 and/or the receiving portion 84 may guide the elongate central axis rod 70 along the longitudinal central axis of the central annular portion 80.

As the elongate central axis rod 70 travels along the longitudinal central axis of the central annular portion 80, the outer portions 108 of the bristles 102 remain in the stationary apertures 100 and the inner portion 106 of the bristles 102 travel with the elongate central axis rod 70. This action thereby causes the bristles 102 to change from a substantially perpendicular orientation relative the elongate central axis rod 70, to an angled orientation. As best illustrated in FIG. 7, the travel of the elongate central axis rod 70 along the central axis of the central annular portion 80 will cause the outer portions 108 of the bristles 102 to retract into the central annular portion 80 until only a minimal length of the outer portion 108 of the bristles 102 extend from the central annular portion 80. Accumulated hair is cleaned from the bristles 102 as the bristles 102 are swiped during movement through the apertures 100.

In another exemplary embodiment, the cleaning mechanism as described above may be altered or varied. The bristles 102 may be retracted or caused to be retracted in several other ways. For example, the first endcap 76, the handle 74, and/or the receiving portion 84 may have axial movement relative to the central annular portion 80. As such, the elongate central axis rod 70 may be fixedly attached to the first endcap 76, the handle 74, and/or the receiving portion 84, thereby also allowing the bristles 102 attached to the elongate central axis rod 70 to move relative to the central annular portion 80. More specifically, the handle 74 may be fixedly attached to the receiving portion 84 and the elongate central axis rod 70, which may all slidably engage the first endcap 76 that may be fixedly attached to the central annular portion 80. In this arrangement the handle 74 may be pushed or pulled relative to the first endcap 76 and the central annular portion 80, thereby causing the bristles 102 to retract and/or extend from the central annular portion 80.

Alternatively, as seen in FIG. 7, receiving portion 84 may be fixedly attached to the elongate central axis rod 70, and the receiving portion 84 may be located in an aperture 115. More specifically, as the elongate central axis rod 70 moves axially within the central annular portion 80, the receiving portion 84 and hence the elongate central axis rod 70 may be guided and aligned by the aperture 115, which may be a tapered hole adapted to slidingly receive the receiving portion 84.

In yet another exemplary embodiment, the mechanisms of the hair brush 20 previously described may be used in a hair roller 20'. The hair roller 20' may include a first end cap 76', a second end cap 78', a generally cylindrical body 80' located between the first end cap 76' and the second end cap 78', an activation button 82', and a receiving portion 84'. A second side 88' of the first end cap 76' includes a circular recess portion that receives the generally cylindrical body 80'. A first side 90' of the second end cap 78' receives the other end of the generally cylindrical body 80' and, more specifically, receives the generally cylindrical body 80' within a circular recess. The activation button 82' is located along the central longitudinal axis of the generally cylindrical body 80' within the second end cap 78'. More specifically, the activation button 82' includes a first end 94' and a second end 96', wherein the first end 94' is adapted to be engaged by a user, and the second end 96' includes a cup portion 98' adapted to receive a elongate central axis rod 70'. A plurality of apertures 100' located around the generally cylindrical body 80' receive bristles 102' that are disposed from the elongate central axis rod 70' through the apertures 100'.

The elongate central axis rod 70' may have a semi-rigid to rigid construction from which the bristles 102' extend. More specifically, as in this example, the elongate central axis rod 70' is constructed from a plurality of rods or wires 104' that are twisted together to form the elongate central axis rod 70'. The bristles 102' extend radially outward from the elongate central axis rod 70' and are fixedly attached thereto.

The hair brush system includes a plurality of hair brushes 20, wherein each hair brush 20 may have a self-cleaning feature and may be optimized for comfort, as described above. The plurality of brushes are customized for different types and/or styles of hair.

For example, the user's type of hair may be described in many ways including, but not limited to, the length of the hair, the amount or density of hair, the shape of the hair, and the thickness or shape of the diameter of the hair strands. The length of the user's hair, as measured from the scalp of the user to the ends of the strands of hair, may be separated into two or more categories and, as in this example, may be categorized as being, short, medium, or long. Short hair, merely for example, may be defined as having a length of 0-4 inches, medium length hair may be defined as having a length of 4-9 inches, and long hair may be defined as having a length of 9 inches and longer.

The amount or density of the user's hair (i.e. the number of strands of hair per unit area of scalp) may also be separated into two or more categories and, as in this example, may be categorized as being, fine, medium, or thick.

The texture of the user's hair or the amount of curliness or lack thereof, may be separated into two or more categories, and as in this example, may be categorized as being straight, wavy, curly, and kinky. Straight hair, for example, may be defined as strands of hair having an arc of less than 15 degrees per inch, and the cross-sectional shape of the hair strand's diameter is circular, wavy hair may be defined as strands of hair having an arc of 15-45 degrees per inch and the cross-sectional shape of the hair strand's diameter is oval, and curly hair may be defined as having strands of hair having an arc of 45 degrees or greater per inch and the cross-sectional shape of the hair strand's diameter is irregular with consistency, and kinky hair may be defined as strands of hair having an arc of 45 degrees or greater per inch and the cross-sectional shape of the hair strand's diameter is irregular shaped without consistency.

The thickness of the user's strands of hair may also be separated into two or more categories and, as in this example, may be categorized as being fine, regular, or thick. Due to the complexity of measuring the actual thickness of the user's strands of hair, however, the thickness of the user's strands of hair may be quantified or categorized in other ways. For example, it may be said that a relationship exists between the actual diameter of the user's strands of hair and the manner, or volume, in which the strands of hair lay on the user's scalp. More specially, the user's strands of hair will fall and rest in an overlapping manner on the user's scalp. The thicker the strands of hair, the more volume and more depth the hair will have. Therefore, by measuring the depth or volume of the hair as it lays on the user's scalp (i.e. from the scalp of the user to the top of the last layer of hair) the thickness of the strands of hair may be categorized. Fine strands of hair, for example, may be apparent in individuals whose depth of hair measures less than 0.5 inches measured from scalp to the last layer of hair, regular strands of hair may be apparent in individuals whose depth of hair measures 0.51" to 0.60" inches measured from scalp to the last layer of hair, and thick strands of hair may be apparent in individuals whose depth of hair measures 0.60" inches or greater from scalp to the last layer of hair.

The user's type of hair, however, may be largely influenced and effected by the hair style, such that the type of hair is made less of a factor or even irrelevant in customizing the hair brush 20. For example, a user's style of hair may include, but is not limited to, altering the user's hair such as with a permanent treatment or hair extensions, adding hair care products such as conditioner, gel or moose, and/or utilizing styling tools, such as a hair dryer, curling iron, hair rollers, hair straightener, etc. Therefore, in determining the type of hair brush 20 to be used with the user's hair, the style of hair may also be considered.

In customizing the hair brush 20 to the user's hair, several features of the hair brush 20 may be altered to obtain the hair brush 20 best suited for the user's hair type. These can include, but need not be limited to, a density of the bristles 26, 102 and/or a length of the bristles 26, 102. For example, other features of the hair brush 20 may be altered, such as the shape of the bristles 26, 102 and a diameter of the bristles 26, 102.

Figure 8:
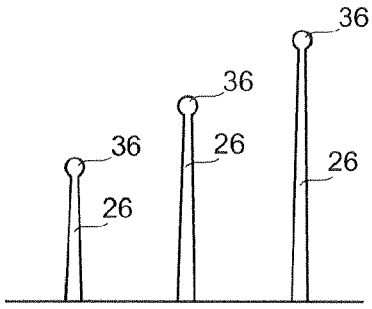
FIG. 8 is a cross-sectional view of short, medium, and long bristles.

For example, depending on the type and/or style of the user's hair, the length of the bristles 26, 102 of the hair brush 20, may be one of several lengths. More specifically, as in the examples disclosed, the bristles 26, 102 may be short, medium or long, as measured from the top of the outside surface 40 of the front part 30 of the body 22 to the tip 36 of the bristles 26 or from the central annular portion 80 to the outer section 108 of the bristles 102, as illustrated in FIG. 8. Short bristles may be approximately 0.876 inches in length or shorter, medium bristles may approximately 0.97-0.877 inches in length, and long bristles 30 may be 0.98 inches or longer.

Figure 9:
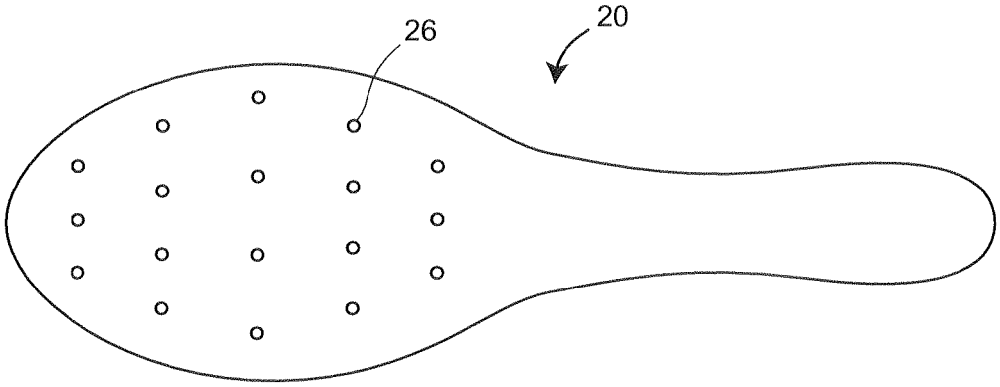
FIG. 9 is a front plan view of a low-density bristle pattern of an oval brush.
Figure 11:
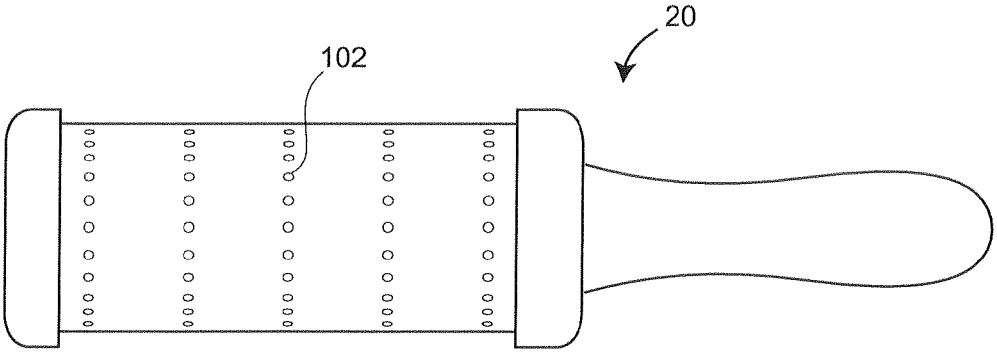
FIG. 11 is a cross-sectional view of a low-density bristle pattern of a round brush.
Figure 12:
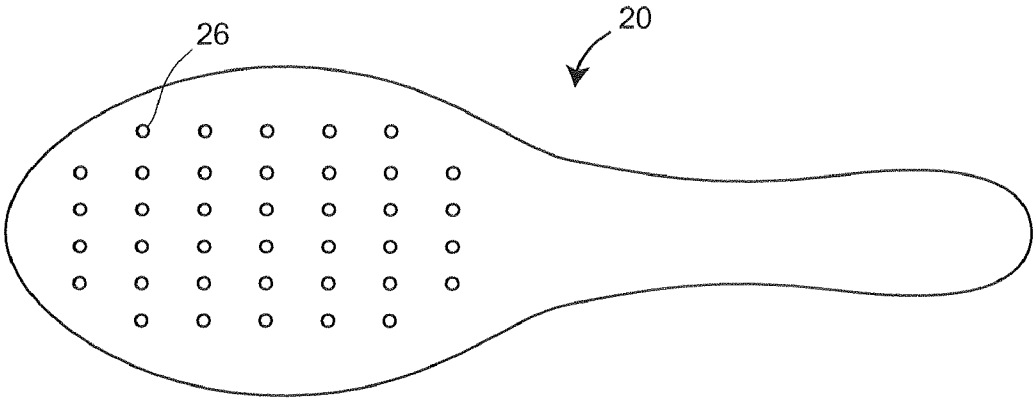
FIG. 12 is a front plan view of a medium-density bristle pattern of an oval brush.
Figure 14:
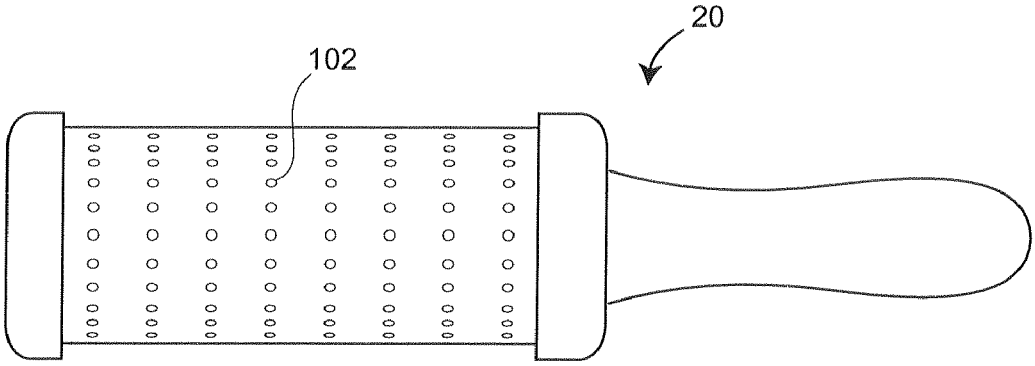
FIG. 14 is a cross-sectional view of a medium-density bristle pattern of a round brush.
Figure 15:
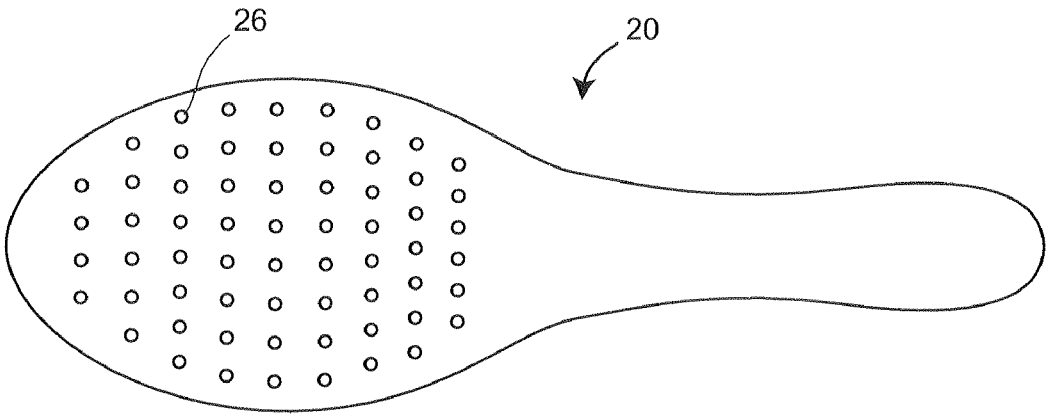
FIG. 15 is a front plan view of a high-density bristle pattern of an oval brush.
Figure 17:
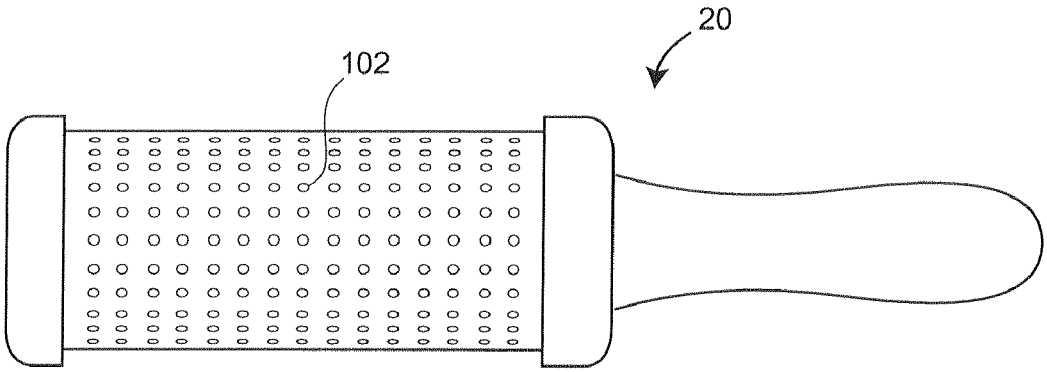
FIG. 17 is a cross-sectional view of a high-density bristle pattern of a round brush.

Similarly, the density of the bristles 26, 102 of the hair brush 20, may vary depending on the type and/or texture of the user's hair. The density may be directly related to the stiffness of the bristle, such that the various stages or categories of densities may correlate to the various stages of stiffness of the bristles. More specifically, as in this example, the hair brush 20 may have a heavy, medium or light density of bristles 26, 102. For example, a hair brush having a heavy density of bristles 30, as illustrated in FIGS. 15-17, may have approximately 0.125 to 45" spacing between each bristle or less, a hair brush 20 having a medium density of bristles 26, 102, as illustrated in FIGS. 12-14, may have approximately 0.451 to 0.55" spacing between each bristle, and a hair brush having a light density of bristles 26, 102, as illustrated in FIGS. 9-11, may have approximately 0.56" to 0.75" spacing between each bristle or more.

Additionally, the diameter and/or shape of the bristles 26, 102 of the hair brush 20, may vary depending on the type and/or texture of the user's hair. The diameter and/or shape may be directly related to the stiffness of the bristle, such that the various stages or categories of diameter and/or shape may correlate to the various stages of stiffness of the bristles. More specifically, as in this example, the hair brush 20 may have a fine, medium or thick diameter and/or shape of bristles 26, 102.

In optimizing the hair brush 20 for the user's type and/or style of hair, a combination of the density of the bristles 26, 102 and the length of the bristles 26, 102, best suited for the user's type and texture of hair may be used. For example, a hair brush having a heavy density of short bristles 26, 102 may be best suited for a person with straight and fine hair. Contrarily, a hair brush 20 having a light density of long bristles 26, 102 may be best suited for a person with curly and thick hair.

It should be understood, however, that in optimizing the hair brush 20 for the user's type and/or texture of hair, not all features of the hair brush 20 need be altered, nor need all the various types of hair be considered. For example, the bristles 26, 102 may only vary in length according to the thickness of the user's strands of hair. Similarly, the density of the bristles 26, 102 may only vary according to the texture of the user's hair. Therefore, the length and/or the density of the bristles 26, 102 may be varied according to the user's length, amount, texture, and/or thickness of hair. For exemplary purposes only, the below Chart A provides examples of combinations of length and/or the density of the bristles 26, 102 that may be used with various types of hair.

CHART A

| TYPE OF HAIR | | HAIR BRUSH BRISTLES | |
|---|---|---|---|
| Texture | Thickness | Length | Density |
| Straight | Fine | Short | High |
| Straight | Medium | Medium | High |
| Straight | Thick | Long | High |
| Wavy | Fine | Short | Medium |
| Wavy | Medium | Medium | Medium |
| Wavy | Thick | Long | Medium |
| Curly | Fine | Short | Low |
| Curly | Medium | Medium | Low |
| Curly | Thick | Long | Low |
| Kinky | Fine | Short | Low |
| Kinky | Medium | Medium | Low |
| Kinky | Thick | Long | Low |

FIGS. 18-25 illustrate a retractable-bristle hair brush 200 according to another example embodiment. This embodiment is similar to the example embodiment of FIGS. 6-7 in that it includes a brush head 210 and a brush handle 212, with the brush head including a barrel (i.e., a central annular portion) 214 with a plurality of apertures 216 in it that receive therethrough bristles 218 that extend radially outward from a central bristle rod (i.e., an elongate central axis rod) 220. The bristle rod 220 is positioned within the barrel 214, and the bristles 218 are movable between an extended position (i.e., a user position) for normal use and a retracted position (i.e., a cleaning position) for cleaning the brush or untangling the brush from hair.

The hair brush 200 of this embodiment, however, includes a different mechanism for moving the bristles 218 between the extended and retracted positions. In particular, the brush 200 is assembled into two components, the brush head 210 and a bristle/handle assembly 222, that move relative to each other. The brush head 210 includes the apertured barrel 214, and the bristle/handle assembly 222 includes the handle 212 and a bristle tree assembly 224. The bristle tree assembly 224 includes the bristle rod 220, the bristles 218 extending from the bristle rod, and a connecting rod 226 extending coaxially from the bristle rod. The connecting rod 226 extends out of the barrel 214 and is attached to the handle 212. The connecting rod 226 is fixedly attached to the handle 212 so that the handle and the bristles 218 move together.

The barrel 214 is not fixedly attached to the bristles 218, the handle 212, or any other part of the bristle/handle assembly 222. The bristles 218 extend through the apertures 216 in the barrel 214 and can contact the barrel, but they are not attached to the barrel. So the bristle/handle assembly 222 and the head 210 are capable of a longitudinal/axial sliding motion relative to each other, with the bristle rod 220 (at least the portion where the bristles extend from) remaining within the barrel 214.

Figure 18:
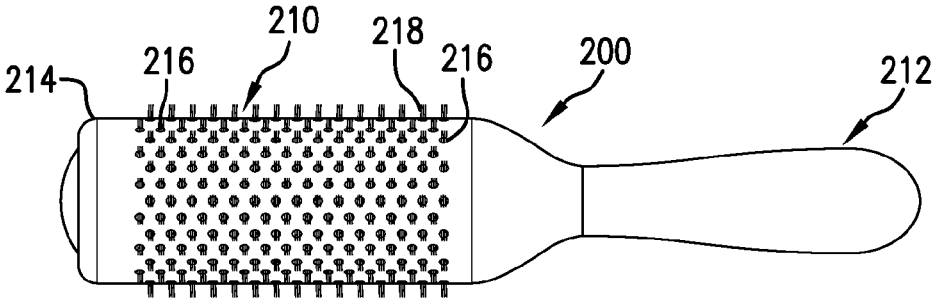
FIG. 18 is a side view of a retractable-bristle hair brush according to another example embodiment of the invention, showing the brush in a use/extended-bristle position.
Figure 20:
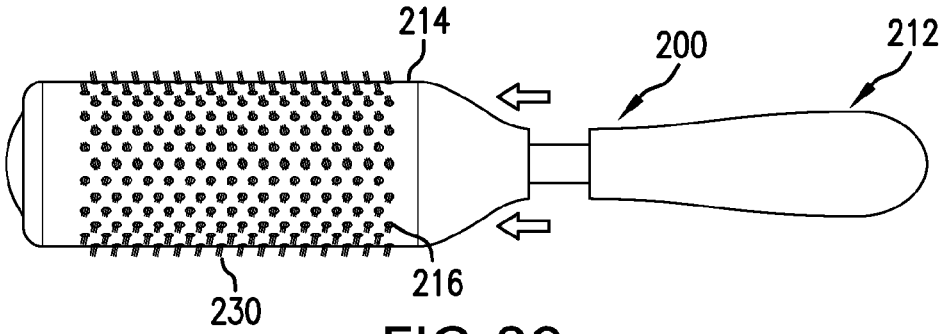
FIG. 20 is a side view of the hair brush of FIG. 18 in a cleaning/retracted-bristle position.
Figure 24:
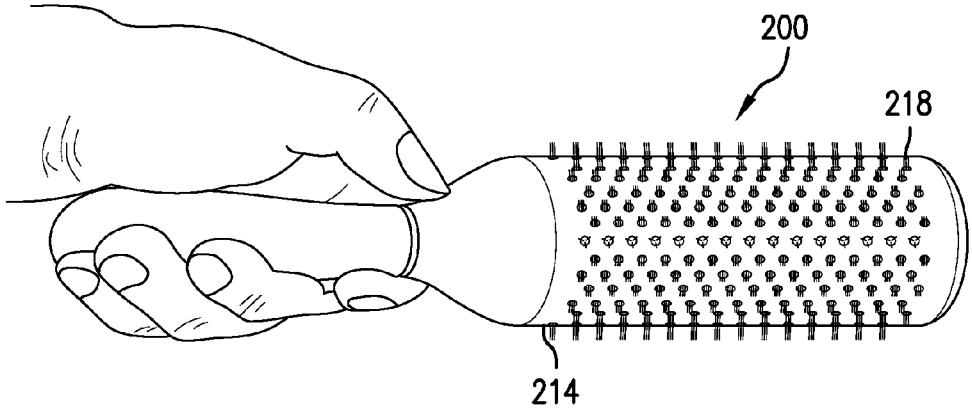
FIG. 24 is a side view of the hair brush of FIG. 18 in the retracted-bristle position.

When the handle 212 is positioned adjacent or abutting the barrel 214, the bristles 218 are in the extended position (with enough of the lengths of the bristles extending out of the barrel for use), as shown in FIGS. 18, 20, and 24. In the extended position of the depicted embodiment, the bristles 218 are generally perpendicular to the bristle rod 220 and the barrel 214.

Figure 19:
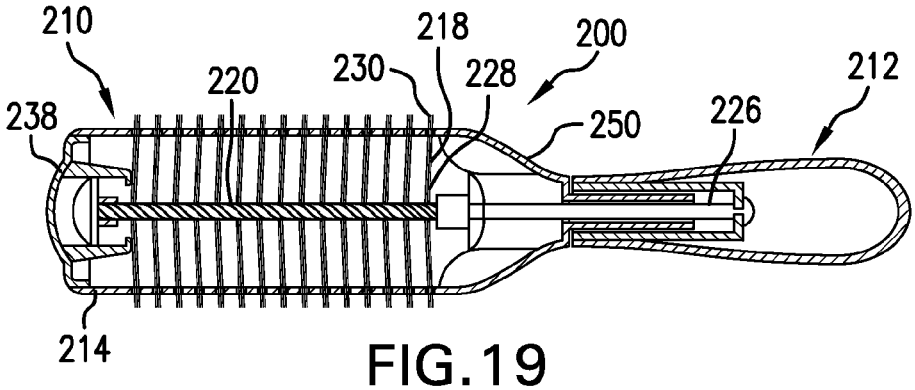
FIG. 19 is a longitudinal cross-sectional view of the hair brush of FIG. 18.
Figure 21:
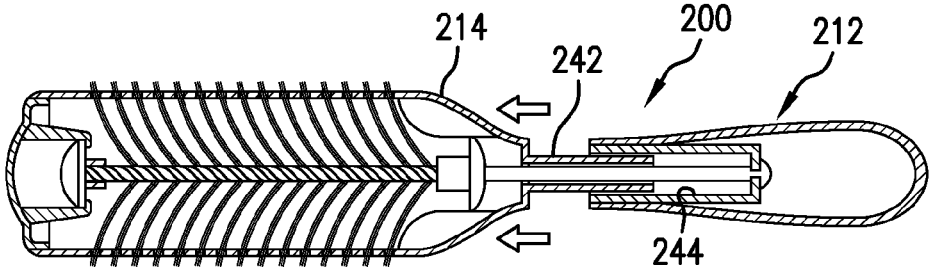
FIG. 21 is a longitudinal cross-sectional view of the hair brush of FIG. 20.
Figure 22:
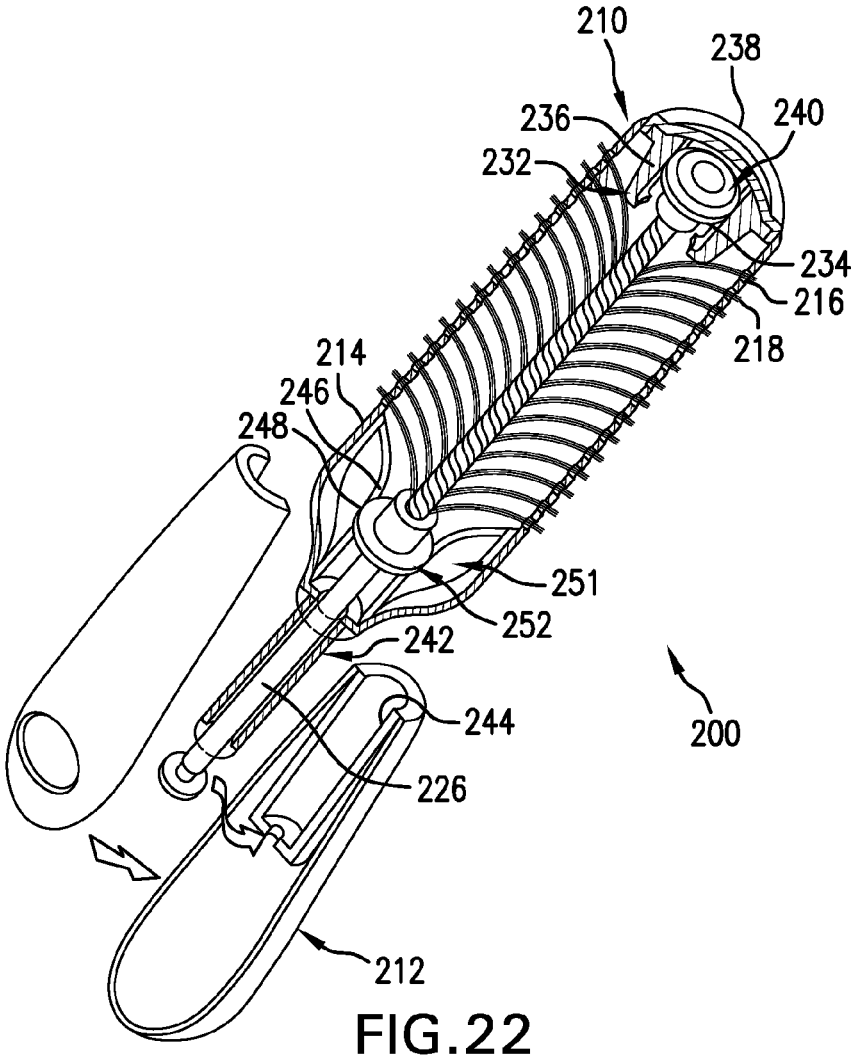
FIG. 22 is an exploded view, in partial cross-section, of the hair brush of FIG. 18.
Figure 23:
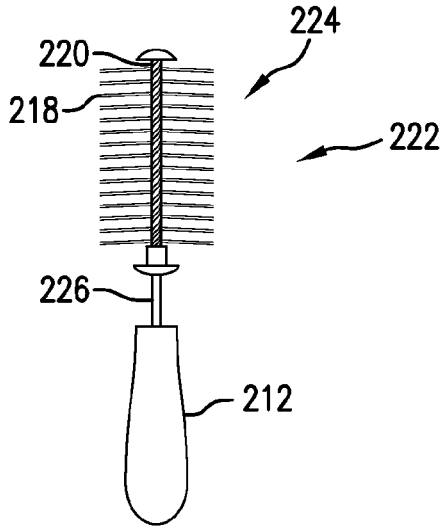
FIG. 23 is a side view of a bristle/handle assembly of the hair brush of FIG. 18.
Figure 25:
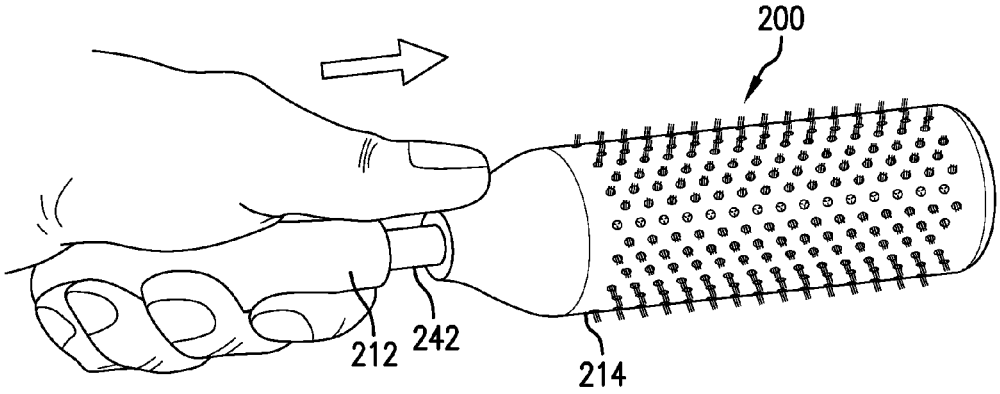
FIG. 25 is a side view of the hair brush of FIG. 24 in theretracted-bristle position.

But when a longitudinal separating force is applied to the handle 212 and/or the barrel 214, they longitudinally slide apart from each other. The bristle rod 220 is attached to (via the connecting rod 226) and travels with the handle 212, so the bristle rod moves longitudinally within the barrel 214 along a central axis of the barrel and moves the bases 228 of the bristles 218 with it. But the bristles 218 still extend through the apertures 216 of the barrel 214, with the free tips 230 of the bristles 218 outside of the barrel 214. This longitudinally sliding action causes the bristles 218 to deform from the generally perpendicular orientation to an angled orientation relative to the bristle rod 220 and the barrel 214, thereby withdrawing the bristles to the retracted position (with more of the lengths of the bristles retracted to within the barrel), as shown in FIGS. 19, 21, and 25.

The bristles 218 are made of a resilient material to provide a spring action such that, upon releasing the separating force from the handle 212 or the barrel 214, the handle and the barrel longitudinally slide back toward each other, returning the bristles 218 to the extended position. In a typical commercial embodiment, the bristles 218 are made of extruded nylon and have a diameter of about 30 mm to about 40 mm. In an alternative embodiment, the bristles 218 include boar bristles for adding shine. In another alternative embodiment, the bristles 218 provide none or only part of the spring action, and the brush 200 includes a spring element such as a metal or plastic helical or leaf spring that biases and longitudinally slides the handle 212 and the barrel 214 back toward each other to return the bristles 218 to the extended position.

In order to prevent the handle 212 and the barrel 214 from being longitudinally slid so far apart that the bristles 218 retract all the way through the apertures 216 and into the barrel, the sliding motion may be limited. In particular, the longitudinal sliding motion may be limited to a distance such that the bristle tips 230 are not retracted through the apertures 216 and into the barrel 214.

The longitudinal sliding distance and the length of the bristles 218 will depend on the peripheral dimension (e.g., diameter) of the barrel 214. In typical commercial embodiments, for example, the longitudinal sliding motion is limited to about 14 mm to about 16 mm for a 33 mm diameter round brush, about 20 mm to about 22 mm for a 43 mm diameter brush, and about 17 mm to about 19 mm for a 53 mm diameter brush. In these typical commercial embodiments, the total length of the bristles 218 is about 46 mm to about 48 mm for a 33 mm diameter round brush, about 60 mm to about 62 mm for a 43 mm diameter brush, and about 72 mm to about 74 mm for a 53 mm diameter brush. In addition, the length of the "use" portion of the bristles 218 (the portion extending from the outer surface of the barrel 214 to the bristle tips 230 in the extended position) is about 5 mm to about 10 mm in these typical commercial embodiments. Lengths of the use portion of the bristles in this range tend to produce good results in providing the spring action of returning the bristles to the extended position, as described above.

A mechanical stop mechanism may be included for providing the limited longitudinal sliding distance of the handle 212 and the barrel 214. For example, the brush head 210 may include one or more stop surfaces 232 that are contacted by one or more contact surfaces 234 of the bristle/handle assembly 222 to limit the longitudinal sliding travel. In the depicted example embodiment, stop surfaces 232 are formed on distal arms 236 extending longitudinally inward from a distal end 238 (e.g., an endcap) of the brush head 210, and contact surface portions 234 are formed on a periphery of a distal disk 240 of the bristle tree 224 (see FIG. 22). In this way, the travel of the bristle tree 224 is limited so that the bristles 218 cannot be retracted all the way into the barrel 214. This is advantageous because re-aligning the bristles 218 through the apertures 216, after they have been collapsed to entirely within the barrel 214, can be difficult.

In an alternative embodiment, the stop surfaces are formed on a radially inwardly extending lip of an axial sleeve that extends longitudinally inward from the distal end of the brush head. This axial sleeve may be sized and shaped to additionally function as an axial alignment guide (discussed below). And in another alternative embodiment, the stop surfaces are formed on the bristle tree and the contact surfaces are formed on the barrel to limit the longitudinal sliding travel (the opposite arrangement of the depicted embodiment).

In order to facilitate a smooth, generally linear, longitudinal sliding motion of the handle 212 relative to the barrel 214, one or more axial alignment guides may be provided. In the depicted example embodiment, for example, an axial guide sleeve 242 extends from the proximal end of the head 210 (see FIG. 22). The guide sleeve 242 telescopically receives the connecting rod 226 in it and extends into the handle 212 a distance such that it generally conceals the connecting rod when the brush 200 is in the retracted position. In addition, the handle 212 may have an internal guide track 244 that telescopically receives the guide sleeve 242. The connecting rod 226, the guide sleeve 242, and the guide track 244 have conforming geometric surfaces and are radially dimensioned to provide good guidance and smooth sliding. In the depicted example embodiment, for example, the connecting rod 226 is generally cylindrical, the guide sleeve 242 is generally annular with generally cylindrical inner and outer surfaces, and the guide track 244 has a generally cylindrical inner surface.

In an alternative embodiment, the guide sleeve extends distally from the handle and into the barrel (the opposite arrangement of the depicted embodiment). In other alternative embodiments, the connecting rod, guide sleeve, and guide track have rectangular or other cross-sectional shapes. And in yet other alternative embodiments, the guide sleeve extends longitudinally into the barrel (in addition to or instead of extending into the handle) for guidance. In embodiments with a guide sleeve extending into the barrel, a guide sleeve extending into the handle may not be needed, and the connecting rod may be attached directly to the distal end of the handle.

An additional axial alignment guide may be included, though in some embodiments only one is used. For example, the brush 200 may include first axial guide surfaces 246 of the head 210 that are engaged by second axial guide surfaces 248 of the bristle tree 224 to facilitate the smooth sliding motion of the handle 212 relative to the barrel 214. The depicted example embodiment includes first axial guide surfaces 246 formed on three spaced-apart fin-like guide bosses 250 that extend radially inward from the barrel 214, and second axial guide surfaces 248 formed on the periphery of a guide disk 252 mounted on the bristle tree 224 between the bristles 218 and the connecting rod 226 (see FIG. 22).

In an alternative embodiment, first axial guide surfaces are formed on an annular guide sleeve that extends axially inward from the proximal end of the barrel. In another alternative embodiment, there are more or fewer than three of the fin-like guide bosses. In yet another alternative embodiment, the fin-like guide bosses include stop surfaces for contact by the second axial guide surfaces to limit the sliding travel of the handle relative to the barrel.

As discussed above, the barrel 214 and the bristle/handle assembly 224 are not attached to each other and instead are capable of a longitudinal/axial sliding motion relative to each other. In addition, they may be also capable of rotational movement relative to each other. Such rotational movement is not generally a problem during the normal use of the brush 200. However, an anti-rotation mechanism can be included, if desired. For example, one of the above-described mechanical stops or axial alignment guides may include mating keyed alignment elements that cooperate to prevent rotation of the barrel 214 relative to the bristle/handle assembly 224. Such keyed alignment elements may include for example a tab on a connecting rod 226, distal arm 236, or guide boss 251 that slides in a groove of a guide sleeve 242, distal disk 240, or guide disk 252, respectively.

Having described certain functional features of the brush 200, details of its construction will now be provided. In the depicted embodiment, the barrel 214 is generally cylindrical in shape (i.e., barrel-shaped). In alternative embodiments, the barrel has another shape such as an octagonal or other polygonal shape or another regular or irregular shape. The barrel 214 may be made of metal, plastic, or another material.

In the depicted embodiment, the brush head 210 includes an innovative barrel 214 with no seams on its lateral surface (e.g., its cylindrical outer surface), thereby reducing locations where the hair can snag and cause discomfort. At the distal end of the brush head 210, the distal endcap 238 plugs into the distal opening in the barrel 214, with the endcap snapping into the opening so that there are no edges or seams on the outer cylindrical surface of the barrel. No part of the endcap 238 overlies the outer cylindrical surface of the barrel 214. At the proximal end of the brush head 210, the barrel 214 extends continuously to form a neck 250 with a smaller diameter than the perforated portion of the barrel. The neck 250 narrows the diameter of the barrel 214 down to the diameter of the handle 212. In a typical commercial embodiment, the barrel 214 is drawn and formed of aluminum, similarly to how aluminum beer bottles are made. The result is that there are no seams or junctions formed in the outer cylindrical surface of the barrel 214, producing a brush 200 that in use is less likely to cause hair snagging.

In alternative embodiments, the barrel 214 is an injection-molded unit containing resin additives such as ceramics, tourmaline, CUPRON (copper oxide), and the like that provide features for heat retention, anti-static, and anti-fungal properties. Injection-molding the barrel 214 provides the opportunity to mold in features to allow proper axial alignment of the bristle tree 224 when the barrel is moved relative to the bristle tree. In another alternative embodiment, the barrel 214 is manufactured by extruding and perforating a tube and cutting it to length, then assembling it onto an injection-molded brush neck component (which may contain molded-in alignment and sleeve features), similarly to the construction in the above-described embodiment of FIGS. 6-7. The barrel 214 may be secured to the neck with an adhesive, fasteners (e.g., screws), a snap fit, or the like. In yet another alternative embodiment, the barrel 214 includes radially inwardly extending sleeves at the apertures 216 so that the tips 230 of the bristles can be retracted to within the barrel but still be guided back to the extended position.

The bristle tree 224 may be of the same construction as that in the above-described embodiments of FIGS. 6-7. The bristle rod 220 can have a semi-rigid or rigid construction from which the plurality of bristles 218 extend. For example, the bristle rod 220 can be constructed from a plurality of rods or wires that are twisted together to wedge the bristles 218 in place so that the bristles are splayed 360 degrees about the bristle rod. In an alternate embodiment, the bristle tree includes a solid or hollow core bristle rod with the bristles tufted into its surface. And in yet another alternate embodiment, the bristle rod is molded using conventional molding techniques, including being integrally molded with the bristles.

The handle 212 may be of a conventional construction. For example, it can be made of hard plastic and covered with a TPE (thermoplastic elastomer), PVC, SANTOPRENE, neoprene, EVA foam, or the like to provide a comfortable, resilient gripping surface.

The assembly process of the brush 200 of the depicted embodiment will now be described. The bristle tree assembly 224, the handle 212, and the head 210 are constructed as described above. The bristle tree assembly 224 is slid through the distal opening of the barrel 214 and into the interior of the barrel until the connecting rod 226 extends out of the proximal end of the barrel. Then the handle 212 is slid onto the connecting rod 226. The connecting rod 226 and the handle 212 have mating coupling elements that lock the connecting rod into the handle. The coupling elements may be provided by, for example, a plug on the connecting rod that snaps into an aperture in the handle (as depicted), a Christmas tree connector or similar connector with flexible fingers or tabs that flex when their angled leading edge enters an aperture in the handle 212, an adhesive such as cyanoacrylate glue or epoxy, mating threads on the connecting rod and handle for a screw-in fit, or the like. Then the distal endcap 238 is snapped into the distal opening of the barrel 214, with the distal-end mechanical stop elements (e.g., the stop and contact surfaces of the distal arms and disk) engaging each other, to complete the assembly.

The operation of the brush 200 to retract the bristles 218 will now be described. When the brush 200 is in the extended position, the barrel 214 is held in place on the bristle tree 224 by the bristles 218 extending through the apertures 216 in the barrel. When the brush 200 is held by the handle 212, the user merely places a finger (e.g., the thumb) on the neck of the head 210 and pushes (see FIGS. 24 and 25). This longitudinal/axial separating force will cause the barrel 214 to longitudinally slide away from the handle 210. The bristles 218 are attached to the bristle rod 220, which is attached to the connecting rod 226, which is attached to the handle 210, so the bristles do not slide with the barrel 214. Instead, the bristles 218 travel with the handle 210 and deflect against the aperture-defining walls of the barrel 214, thereby retracting the bristles farther into the barrel 214 to the retracted position. In the retracted position, excess hair can be more easily removed from the brush 200, and if the brush has become entangled in the user's hair it now can be more easily removed from the hair. When the separating force is withdraw (e.g., by removing the finger on the neck or just releasing the force applied by the finger), the resilient bristles 218 elastically return to their neutral state, thereby biasing the barrel 214 back to its original position so that the bristles are again in the extended position.

Advantageously, the round brush 200 can be manipulated by the user with one hand to retract the bristles 218, such as when the user's hair gets entangled around the bristles. It is common to use round brushes while blow-drying hair. Thus, the brush 200 of the present invention allows the user to manipulate the brush with one hand, while leaving the other hand free to use a handheld hair dryer. In addition, this embodiment advantageously provides for ease of use regardless of the rotational position of the brush 200 in the user's hand. That is, there is no one button or other element that must be located and manipulated in order to retract the bristles 218. Instead, the brush 200 of the present invention provides for 360 degree hand-position operability, meaning that regardless of the rotational position of the user's hand on the handle, the user can always easily locate the neck anywhere along its circumference and apply a separating force to retract the bristles 218.

In alternative embodiments, instead of the bristle-retraction feature being included in a hair brush, it is adapted for inclusion in a comb-like apparatus to retract bristles, for example, in a boar finishing comb. And in other alternative embodiments, the bristle-retraction feature is adapted for inclusion in a powered (e.g., electric or gaseous) hairdryer wand with a round brush head of the type that is commercially available.

Figure 26:
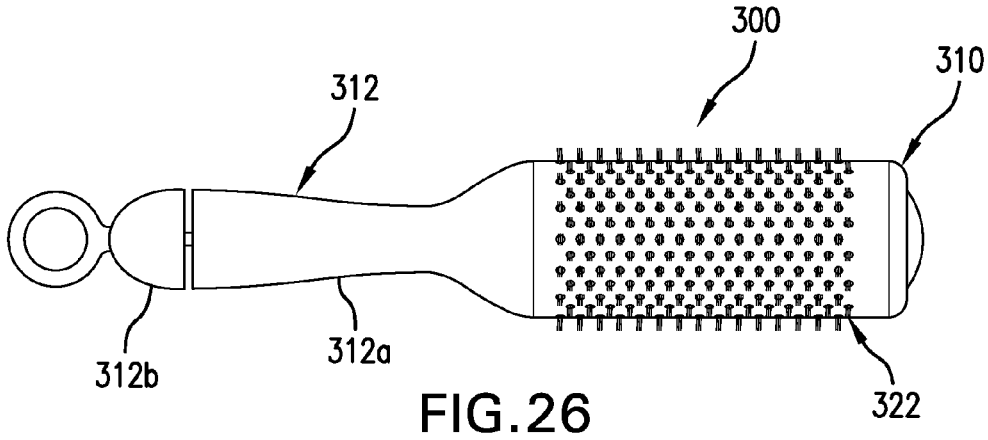
FIG. 26 is a side view of a retractable-bristle hair brush according to another example embodiment of the invention, showing the brush in a use/extended-bristle position.
Figure 27:
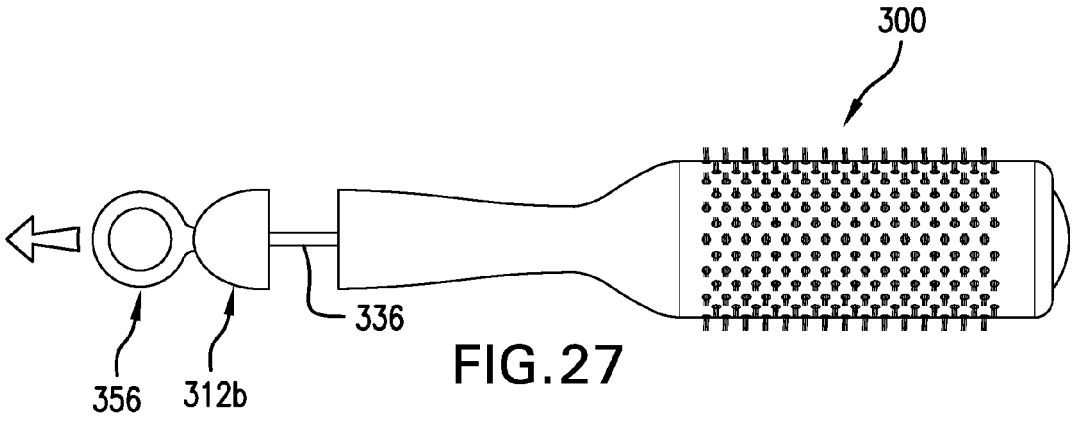
FIG. 27 is a side view of the hair brush of FIG. 26 in a cleaning/retracted-bristle position.

FIGS. 26 and 27 illustrate a retractable-bristle hair brush 300 according to another example embodiment of the present invention. The brush 300 of this embodiment is similar to that shown in FIGS. 18-25 in that it includes an apertured brush head 310, a brush handle 312, and a longitudinally slidable bristle tree 322 within the head. In this embodiment, however, a first gripping portion of the handle 312 is attached to the head 310, for example, by being formed as a single component. And the connecting rod 336 that extends axially from the bristle tree 322 is not attached to the gripping portion 312*a* of the handle 312, but instead extends all the way through it and is attached to a plunger portion 312*b* of the handle at its proximal end. The plunger portion 312*b* may have a finger-engagement element for example the loop 356 depicted, a partial loop, a curved lever, or the like. When the brush 300 is in the extended position of FIG. 26, the bristles extend through the apertures in the barrel of the head 310. And when the user applies an axial separating pulling force to the loop 356 (for example with the little finger), the handle plunger portion 312*b* is longitudinally slid apart from the head 310. This pulls the connecting rod 336 and thus the bristle tree 322, thereby retracting the bristles to the retracted position of FIG. 27.

Figure 28:
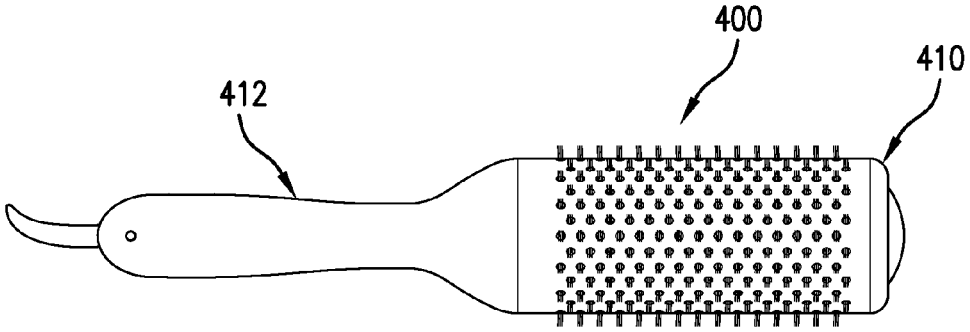
FIG. 28 is a side view of a retractable-bristle hair brush according to another example embodiment of the invention, showing the brush in a use/extended-bristle position.
Figure 29:
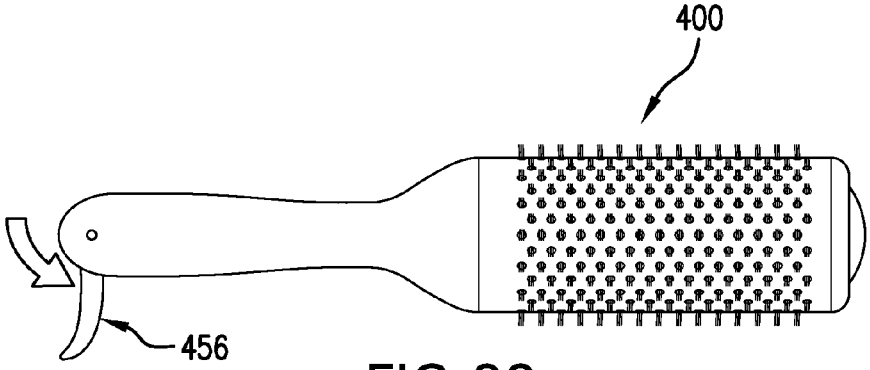
FIG. 29 is a side view of the hair brush of FIG. 28 in a cleaning/retracted-bristle position.
Figure 30:
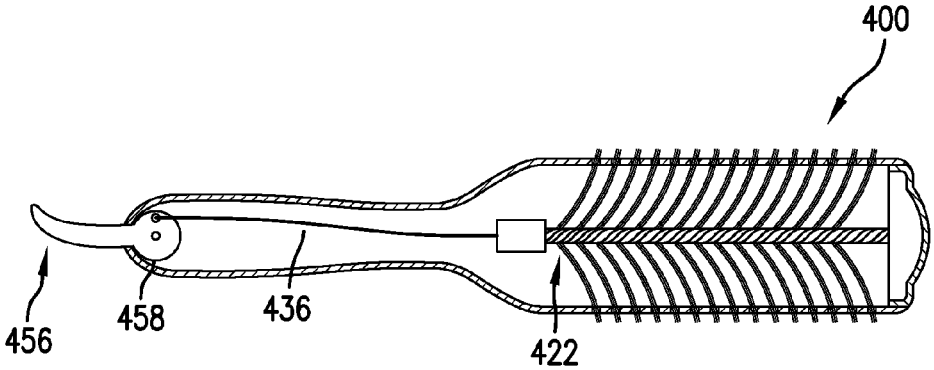
FIG. 30 is a longitudinal cross-sectional view of the hair brush of FIG. 28.

FIGS. 28-30 illustrate a retractable-bristle hair brush 400 according to another example embodiment of the present invention. The brush 400 of this embodiment is similar to that shown in FIGS. 26 and 27 in that it includes an apertured brush head 410, a brush handle 412 extending from the head, and a longitudinally slidable bristle tree 422 within the head. This embodiment, however, includes a cam-operated bristle-retraction mechanism. In the depicted embodiment, for example, the connecting rod 436 is attached to a cam 458, which is rotationally mounted within or onto the handle 412 and has a finger-engaging element 456 extending from it. In the depicted embodiment, for example, the cam 458 is positioned within the handle 412 at its proximal end and the finger-engaging element 456 is provided by a lever/trigger that extends through a slot in the proximal end of the handle. In this embodiment, a rotary separating force can be applied by the user's little finger to the lever 456, which rotates the cam 458, which longitudinally slides the bristle tree 422, thereby retracting the bristles from the extended position of FIG. 28 to the retracted position of FIG. 29. In an alternative embodiment, the cam is positioned in the neck of the brush and the finger-engaging element extends laterally out of the neck of the handle. The brush 400 may be provided with stop and guide features such as the type in the above-described embodiments.

While the above has been described with reference to specific examples which are intended to be illustrative only and not to be limiting of the invention, it will be apparent to those of ordinary skill in the art that changes, additions, or deletions may be made to the disclosed embodiments without departing from the spirit and scope of the invention.

What is claimed is:

1. A retractable-bristle hair brush, comprising:

a brush head with a plurality of apertures formed therein;

a bristle tree including a bristle rod and a plurality of bristles extending from the bristle rod, wherein the bristle rod is positioned within the head with the bristles extending through the apertures and a free tip of each of the bristles positioned outside of the head in an extended position;

a handle with at least a portion that is not attached to the brush head and that slides longitudinally relative to the brush head;

a connecting rod extending between and coupled to the bristle tree and the handle portion; and a stop mechanism adapted to limit the longitudinal sliding of the handle portion relative to a barrel of the brush head, the stop mechanism including one or more stop surfaces that are formed on the head and one or more contact surfaces that are formed on the bristle tree and that contact the one or more stop surfaces to limit the longitudinal sliding, wherein in response to a separating force applied to the handle portion or the brush head, the handle portion and the brush head slide longitudinally relative to each other with the bristle tree traveling with the handle portion to deflect and retract the bristles to a retracted position, and wherein the one or more stop surfaces are formed on distal arms extending longitudinally inward from a distal end of the brush head, and the one or more contact surfaces are formed on a periphery of a distal disk axially positioned on the bristle rod.

2. The retractable-bristle hair brush of claim 1, wherein the handle includes a first gripping portion that is attached to the head and includes a plunger portion at a proximal end of the gripping portion, wherein the connecting rod extends axially from and couples the bristle tree to the plunger portion so that applying the separating force to the plunger portion of the handle or the head moves the bristles to the retracted position.

3. The retractable-bristle hair brush of claim 1, wherein the stop mechanism includes two stop surfaces and two contact surfaces.

4. A retractable-bristle hair brush, comprising:

a brush head with a plurality of apertures formed therein;

a bristle tree including a bristle rod and a plurality of bristles extending from the bristle rod, wherein the bristle rod is positioned within the head with the bristles extending through the apertures and a free tip of each of the bristles positioned outside of the head in an extended position;

a handle with at least a portion that is not attached to the brush head and that slides longitudinally relative to the brush head;

a connecting rod extending between and coupled to the bristle tree and the handle portion; and an axial guide mechanism adapted to axially guide the longitudinal sliding motion of the handle portion relative to a barrel of the brush head, the axial guide mechanism including an axial guide sleeve that extends from a proximal end of the head into the handle portion and that telescopically receives the connecting rod therein, wherein in response to a separating force applied to the handle portion or the brush head, the handle portion and the brush head slide longitudinally relative to each other with the bristle tree traveling with the handle portion to deflect and retract the bristles to a retracted position.

5. The retractable-bristle hair brush of claim 4, wherein the axial guide mechanism further includes an internal guide track within the handle portion that telescopically receives the guide sleeve.

6. A retractable-bristle hair brush, comprising:

a brush head with a plurality of apertures formed therein;

a bristle tree including a bristle rod and a plurality of bristles extending from the bristle rod, wherein the bristle rod is positioned within the head with the bristles extending through the apertures and a free tip of each of the bristles positioned outside of the head in an extended position;

a handle with at least a portion that is not attached to the brush head and that slides longitudinally relative to the brush head;

a connecting rod extending between and coupled to the bristle tree and the handle portion; and an axial guide mechanism adapted to axially guide the longitudinal sliding motion of the handle portion relative to a barrel of the brush head and including one or more first axial guide surfaces formed on the head and one or more second axial guide surfaces formed on the bristle tree that engage and are guided by the one or more first axial guide surfaces, wherein in response to a separating force applied to the handle portion or the brush head, the handle portion and the brush head slide longitudinally relative to each other with the bristle tree traveling with the handle portion to deflect and retract the bristles to a retracted position, and wherein the one or more first axial guide surfaces are formed on fin-like guide bosses that extend inwardly from the head and the one or more second axial guide surfaces are formed on a periphery of a guide disk axially mounted on the bristle rod between the bristles and the connecting rod.

7. A retractable-bristle hair brush, comprising:

a brush head including a generally cylindrical barrel with apertures formed therein;

a bristle tree including a central bristle rod and a plurality of bristles extending generally radially from the rod, wherein the bristle rod is positioned generally along a longitudinal central axis of the barrel with the bristles extending through the apertures in an extended position; and a handle with at least a portion that is not attached to the head and that slides longitudinally relative to the head; and a connecting rod extending between and coupled to the bristle tree and the handle portion; and a stop mechanism adapted to limit the longitudinal sliding of the handle portion relative to the barrel, wherein the stop mechanism includes one or more stop surfaces that are formed on the head and one or more contact surfaces that are formed on the bristle tree and that contact the one or more stop surfaces to limit the longitudinal sliding, and wherein the one or more stop surfaces are formed on distal arms extending longitudinally inward from a distal end of brush head, and the one or more contact surfaces are formed on a periphery of a distal disk axially positioned on the bristle rod, wherein in response to a separating force applied to the handle portion or the head, the handle portion and the head slide longitudinally relative to each other with the bristle tree traveling with the handle portion to deflect and retract the bristles to a retracted position, wherein in the retracted position the bristles are retracted to further within the head relative to the extended position and the free tip of each of the bristles remains outside of the head, and wherein the bristles are biased to the extended position without a separate biasing element, such that when the bristles are in the retracted position and the separating force is released, the handle portion and the brush head longitudinally slide back toward each other and the deflected bristles return to the extended position.

8. The retractable-bristle hair brush of claim 7, wherein the handle includes a first gripping portion that is attached to the head and includes a plunger portion at a proximal end of the gripping portion, wherein the connecting rod extends axially from the bristle tree to the plunger portion so that applying the separating force to the plunger portion of the handle or the head moves the bristles to the retracted position.

9. A retractable-bristle hair brush, comprising:

a brush head including a generally cylindrical barrel with apertures formed therein;

a bristle tree including a central bristle rod and a plurality of bristles extending generally radially from the rod, wherein the bristle rod is positioned generally along a longitudinal central axis of the barrel with the bristles extending through the apertures in an extended position; and a handle with at least a portion that is not attached to the head and that slides longitudinally relative to the head; and a connecting rod extending between and coupled to the bristle tree and the handle portion; and an axial guide mechanism adapted to axially guide the longitudinal sliding motion of the handle portion relative to the barrel, wherein the axial guide mechanism includes an axial guide sleeve that extends from a proximal end of the head into the handle portion and that telescopically receives the connecting rod therein, and wherein the axial guide mechanism further includes an internal guide track within the handle portion that telescopically receives the guide sleeve, wherein in response to a separating force applied to the handle portion or the head, the handle portion and the head slide longitudinally relative to each other with the bristle tree traveling with the handle portion to deflect and retract the bristles to a retracted position, wherein in the retracted position the bristles are retracted to further within the head relative to the extended position and the free tip of each of the bristles remains outside of the head, and wherein the bristles are biased to the extended position without a separate biasing element, such that when the bristles are in the retracted position and the separating force is released, the handle portion and the brush head longitudinally slide back toward each other and the deflected bristles return to the extended position.

10. A retractable-bristle hair brush, comprising:

a brush head including a generally cylindrical barrel with apertures formed therein;

a bristle tree including a central bristle rod and a plurality of bristles extending generally radially from the rod, wherein the bristle rod is positioned generally along a longitudinal central axis of the barrel with the bristles extending through the apertures in an extended position; and a handle with at least a portion that is not attached to the head and that slides longitudinally relative to the head; and a connecting rod extending between and coupled to the bristle tree and the handle portion; and an axial guide mechanism adapted to axially guide the longitudinal sliding motion of the handle portion relative to the barrel, wherein the axial guide mechanism further includes one or more first axial guide surfaces formed on the head and one or more second axial guide surfaces formed on the bristle tree that engage and are guided by the one or more first axial guide surfaces, and wherein the one or more first axial guide surfaces are formed on fin-like guide bosses that extend inwardly from the head and the one or more second axial guide surfaces are formed on a periphery of a guide disk axially mounted on the bristle rod between the bristles and the connecting rod, wherein in response to a separating force applied to the handle portion or the head, the handle portion and the head slide longitudinally relative to each other with the bristle tree traveling with the handle portion to deflect and retract the bristles to a retracted position, wherein in the retracted position the bristles are retracted to further within the head relative to the extended position and the free tip of each of the bristles remains outside of the head, and wherein the bristles are biased to the extended position without a separate biasing element, such that when the bristles are in the retracted position and the separating force is released, the handle portion and the brush head longitudinally slide back toward each other and the deflected bristles return to the extended position.

* * * * *